US008025334B2

(12) United States Patent
Schmitz et al.

(10) Patent No.: US 8,025,334 B2
(45) Date of Patent: Sep. 27, 2011

(54) PIECE OF FURNITURE

(75) Inventors: Johann Burkhard Schmitz, Berlin (DE); Carola Eva Marianne Zwick, Berlin (DE); Roland Rolf Otto Zwick, Berlin (DE); Claudia Plikat, Berlin (DE)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 12/958,798

(22) Filed: Dec. 2, 2010

(65) Prior Publication Data

US 2011/0067931 A1 Mar. 24, 2011

Related U.S. Application Data

(63) Continuation of application No. 12/225,336, filed as application No. PCT/IB2007/000734 on Mar. 22, 2007, now Pat. No. 7,857,390.

(30) Foreign Application Priority Data

| | | |
|---|---|---|
| Mar. 24, 2006 | (DE) | 10 2006 014 109 |
| Apr. 26, 2006 | (DE) | 10 2006 020 006 |
| Apr. 26, 2006 | (DE) | 10 2006 020 007 |
| Jul. 21, 2006 | (DE) | 10 2006 034 307 |
| Jul. 27, 2006 | (DE) | 10 2006 035 553 |
| Aug. 24, 2006 | (DE) | 10 2006 039 606 |

(51) Int. Cl.

| | |
|---|---|
| ***A47C 3/026*** | (2006.01) |
| ***A47C 1/024*** | (2006.01) |
| ***A47C 1/038*** | (2006.01) |

(52) U.S. Cl. ..... 297/300.1; 297/303.1

(58) Field of Classification Search ..... 297/300.1, 297/303.1

See application file for complete search history.

(56) References Cited

U.S. PATENT DOCUMENTS

| | | | | |
|---|---|---|---|---|
| 2,818,911 | A * | 1/1958 | Syak | 297/303.1 X |
| 4,077,596 | A * | 3/1978 | Pinaire et al. | 297/302.3 X |
| 4,387,876 | A * | 6/1983 | Nathan | 297/344.15 X |
| 4,479,679 | A * | 10/1984 | Fries et al. | 297/300.5 |
| 4,653,806 | A | 3/1987 | Willi | |
| 4,709,963 | A * | 12/1987 | Uecker et al. | 297/300.5 |
| 4,711,491 | A * | 12/1987 | Ginat | 297/300.5 |
| 4,761,033 | A * | 8/1988 | Lanuzzi et al. | 297/300.3 |
| 4,763,950 | A * | 8/1988 | Tobler | 297/300.3 |

(Continued)

FOREIGN PATENT DOCUMENTS

| | | |
|---|---|---|
| DE | 8614185.6 | 8/1986 |

(Continued)

OTHER PUBLICATIONS

International Search Report for International Application No. PCT/IB2007/000734, dated Aug. 21, 2008, 1 page.

(Continued)

*Primary Examiner* — Rodney B. White
(74) *Attorney, Agent, or Firm* — Brinks Hofer Gilson & Lione

(57) ABSTRACT

A body support structure, such as a piece of furniture, in particular a piece of furniture for sitting on or a piece of furniture for lying on, such as, for example, chair, armchair, stool, bed or sofa, a seat of the piece of furniture being supported by a spring mechanism, and the spring mechanism being capable of being set to a weight force with which a person acts on the seat.

21 Claims, 29 Drawing Sheets

U.S. PATENT DOCUMENTS

| | | | | | |
|---|---|---|---|---|---|
| 4,840,426 | A | * | 6/1989 | Vogtherr et al. | 297/300.5 |
| 4,889,385 | A | * | 12/1989 | Chadwick et al. | 297/300.1 |
| 4,892,354 | A | * | 1/1990 | Estkowski et al. | 297/303.3 |
| 4,911,501 | A | * | 3/1990 | Decker et al. | 297/300.8 |
| 4,966,411 | A | * | 10/1990 | Katagiri et al. | 297/300.7 |
| 5,029,940 | A | * | 7/1991 | Golynsky et al. | 297/300.4 |
| 5,046,780 | A | * | 9/1991 | Decker et al. | 297/300.8 |
| 5,056,866 | A | * | 10/1991 | Tobler | 297/303.3 |
| 5,080,318 | A | * | 1/1992 | Takamatsu et al. | 297/300.1 X |
| 5,121,934 | A | * | 6/1992 | Decker et al. | 297/300.8 |
| 5,224,758 | A | * | 7/1993 | Takamatsu et al. | 297/300.5 |
| 5,288,138 | A | * | 2/1994 | Stulik et al. | 297/302.1 |
| 5,333,368 | A | * | 8/1994 | Kriener et al. | 297/302.1 |
| 5,348,372 | A | * | 9/1994 | Takamatsu et al. | 297/303.1 |
| 5,375,912 | A | * | 12/1994 | Stulik et al. | 297/302.4 |
| 5,397,165 | A | * | 3/1995 | Grin et al. | 297/300.5 |
| 5,486,035 | A | * | 1/1996 | Koepke et al. | 297/320 |
| 5,511,759 | A | * | 4/1996 | DeKraker et al. | 248/575 |
| 5,547,252 | A | * | 8/1996 | Pfenniger | 297/300.3 |
| 5,551,674 | A | * | 9/1996 | Johnsen | 267/168 |
| 5,653,806 | A | * | 8/1997 | Van Buskirk | 118/715 |
| 5,658,045 | A | * | 8/1997 | Van Koolwijk et al. | 297/300.5 |
| 5,660,439 | A | * | 8/1997 | Unwalla | 297/300.2 X |
| 5,765,914 | A | * | 6/1998 | Britain et al. | 297/300.4 |
| 5,806,930 | A | * | 9/1998 | Knoblock | 297/300.1 |
| 5,810,440 | A | * | 9/1998 | Unwalla | 297/300.2 X |
| 5,909,924 | A | * | 6/1999 | Roslund, Jr. | 297/300.4 |
| 5,909,974 | A | * | 6/1999 | Myung | 400/283 |
| 5,918,935 | A | * | 7/1999 | Stulik et al. | 297/300.5 |
| 5,979,984 | A | * | 11/1999 | DeKraker et al. | 297/300.5 |
| 6,015,187 | A | * | 1/2000 | Roslund et al. | 297/300.4 |
| 6,085,153 | A | * | 7/2000 | Hirsh et al. | 702/23 |
| 6,086,153 | A | | 7/2000 | Heidmann et al. | |
| 6,582,018 | B2 | | 6/2003 | Tseng | |
| 6,582,019 | B2 | | 6/2003 | Insalaco et al. | |
| 6,709,056 | B2 | * | 3/2004 | Bock | 297/300.4 |
| 7,036,882 | B2 | * | 5/2006 | Elzenbeck | 297/300.1 |
| 7,165,811 | B2 | * | 1/2007 | Bodnar et al. | 297/300.2 |
| 7,497,515 | B2 | * | 3/2009 | Krehm et al. | 297/300.3 |
| 7,857,390 | B2 | * | 12/2010 | Schmitz et al. | 297/300.1 |
| 2002/0109384 | A1 | * | 8/2002 | Hansen | 297/300.1 |
| 2003/0137171 | A1 | * | 7/2003 | Deimen et al. | 297/300.1 X |
| 2004/0195883 | A1 | | 10/2004 | Vrijlandt et al. | |
| 2004/0245827 | A1 | * | 12/2004 | Bedford et al. | 297/300.1 |
| 2006/0202530 | A1 | * | 9/2006 | Lin | 297/300.1 |
| 2007/0210634 | A1 | * | 9/2007 | Krehm et al. | 297/303.1 |

FOREIGN PATENT DOCUMENTS

| | | | |
|---|---|---|---|
| DE | 3700447 | A1 | 7/1988 |
| WO | WO 2007/110732 | | 10/2007 |

OTHER PUBLICATIONS

International Search Report for International Application No. PCT/US2008/076605, dated Jan. 28, 2009, 1 page.

Written Opinion of the International Searching Authority for International Application No. PCT/IB2007/000734, dated Aug. 21, 2008, 3 pages.

Written Opinion of the International Searching Authority for International Application No. PCT/US2008/076605, dated Jan. 28, 2009, 6 pages.

International Preliminary Report on Patentability for International Application No. PCT/IB2007/000734, dated Mar. 10, 2009, 4 pages.

International Preliminary Report on Patentability for International Application No. PCT/US2008/076605, dated Mar. 24, 7 pages.

Office Action from co-pending U.S. Appl. No. 12/283,939, dated Oct. 13, 2010, 5 pages.

Office Action from co-pending U.S. Appl. No. 12/283,939, dated Nov. 2, 2010, 5 pages.

girsberger, High Performance Seating., [online] [retrieved from internet: URL http://www.girsberger.com/slideshow_c.htmll, [retrieved on Jul. 22, 1999], 1 page.

Md, international magazine of design, dated Oct. 2006, brochure, 5 pages including pp. 73-75.

* cited by examiner

PIECE OF FURNITURE

This application is a continuation of U.S. application Ser. No. 12/225,336, filed Sep. 18, 2008 now U.S. Pat. No. 7,857,390, which was the National Stage under 35 U.S.C. Section 371 of International Application No. PCT/IB2007/00734, filed Mar. 22, 2007, the entire disclosures of which are hereby incorporated herein by reference.

BACKGROUND OF THE INVENTION

The invention relates to a piece of furniture, in particular a body support structure, including for example a piece of furniture for sitting on or a piece of furniture for lying on, such as, for example, chair, armchair, stool, bed or sofa.

DE 37 00 447 A1 discloses a piece of furniture for sitting on, in which the body weight of a person is detected via the loading of a seat part and in which the leaning force required in order to adjust the inclination of the back part is to be adjusted as a function of the weight force of the person. This automatic adaptation takes place by a spring being compressed by the weight force of the person, with the backrest carrier acting against this compressed spring. A disadvantage of a piece of furniture of this type for sitting on is that, here, only the weight force acting on the seat part can be detected. A weight force introduced via the back part or armrests which may be present cannot be correctly detected by the mechanism, since it is dissipated via the coupling of the carrier of the back part also to the seat carrier. This may possibly result in too weak a reaction force of the carrier of the back part.

Furthermore, U.S. Pat. No. 5,080,318 discloses a control device for the inclination of a chair comprising a weighing device which causes an adjustment of a tension device for a leaf spring which supports an inclination of the seat, the adjustment travel being dependent on the weight of a user. A control device of this type has the disadvantage that the weighing of a user and therefore the setting of the leaf spring take place under load and are therefore sluggish and consequently slow and inaccurate.

SUMMARY

The object on which the invention is based is to develop a body support structure, such as a piece of furniture, in particular a piece of furniture for sitting on, in which a spring mechanism which supports a reclining of a person can be adapted to the weight of the person, while weighing is to be smooth and is to take place quickly and accurately. Furthermore, the object of the invention is to develop a body support structure, such as a piece of furniture, in particular a piece of furniture for sitting or lying on, with a weighing mechanism for controlling the spring mechanism, in which the weighing mechanism can be produced cost-effectively.

The body support structure according to one aspect of the invention has a base, on which at least one seat is articulated, the seat comprising a seat part and a back part, an inclination of the seat about at least one axis of rotation being supported by at least one spring mechanism acting between the seat and the base, the spring mechanism comprising a lever arm and a support, the support being movable out of a position of rest along a curve into different working positions, the support assuming the position of rest when the seat is nonloaded, the support assuming one of the working positions as a function of a weight force with which a person sitting in an upright sitting posture loads the seat, the support being movable freely of a engaging force, which can be generated by the lever arm (51), between its position of rest and one of the working positions, as long as the person is sitting on the seat in the upright sitting posture, the support being engaged by the lever arm by means of the engaging force when the person reclines from his upright sitting posture against the back part into a rearwardly inclined sitting posture, a reaction force of the spring mechanism on the seat being adaptable to the respective weight force of the person by means of the working position of the support. A spring mechanism is thereby available, in which a fixing of the spring mechanism to a set value takes place only when the person reclines. The support and the lever lowerable onto the support thus come into contact with one another only when the person using the piece of furniture reclines and a supporting of the inclination movement is required. Such a low-friction setting of the spring mechanism allows an accurate setting of the spring mechanism, since, even then, an unbraked adjustment of the support under the lever is still possible when the person loads the seat with his entire weight. This ensures that the spring mechanism can reach, uninfluenced, the set value which corresponds to the weight of the person. Furthermore, as soon as the person sits upright, the spring mechanism can set itself to a change in the load. This makes it possible, for example, to vary the set value when the person grasps heavy files. By the set value being readjusted in this way, in particular, accidents can be prevented, since increased loading which takes place in the upright sitting posture always gives rise to a tauter supporting of an inclination movement by means of the spring mechanism.

In one aspect, the invention provides for designing the lever arm as a spring element and, in particular, as a leaf spring. A version of this type makes it possible to have a slender form of construction and to generate high spring forces.

Alternatively or additionally, the invention provides for designing the support as a spring element and, in particular, as a helical spring. By means of a design of this type, particularly compact spring mechanisms can be implemented.

In one aspect, the invention provides for absorbing a torque which is generated about the axis of rotation of the seat by the person sitting in the upright sitting posture on the seat by means of a prestress of the spring element. The unbraked movability of the support can thereby be ensured without additional outlay, even in the case of furniture designs in which the axis of rotation about which the seat is inclined does not lie directly below the center of gravity of a person sitting upright.

There is also provision for absorbing the abovementioned torque by means of an additional spring supporting the lever arm. A design of this type is advantageous particularly when the support is designed as a spring element, since no prestress can be generated by the latter without influencing the smoothness of the spring mechanism.

In one aspect, the invention also provides for absorbing the abovementioned torque by means of a temporary blocking of the rotational movement of the seat about the axis of rotation. By means of a design of this type, particularly high torques can be absorbed at low outlay. For this purpose, the invention provides, in particular, a blocking mechanism which comprises, in particular, a toggle lever which bears under prestress against an abutment, the prestress being capable of being generated by a spring element.

Furthermore, in one aspect, the invention provides for moving the support by means of an operating element. In particular, a handwheel with a weight scale is provided as operating element. A positioning of the support by means of a handwheel is suitable particularly for pieces of furniture which are regularly used by only one person.

According to one aspect of the invention, the base comprises at least one lower part, one middle part and one upper part, the seat being articulated on the upper part, the upper part being guided upward or downward on the middle part, the upper part being supported on the middle part by at least one weighing mechanism, the upper part moving with respect to the middle part, during a first loading of the seat with the first weight force, out of a first position into a second position, counter to a restoring force of the weighing mechanism, with a first weighing movement over a first weighing distance, the upper part moving with respect to the middle part, during a second loading of the seat with the second weight force, out of the first position into a third position, counter to the restoring force of the weighing mechanism, with a second weighing movement over a second weighing distance, this weighing movement of the upper part over the weighing distance being convertible into a traveling movement of the support of the spring mechanism by means of at least one movement converter. A piece of furniture can thereby be implemented which is set automatically to persons of different weight. Due to this automatic self-setting of the piece of furniture, even high loads which may occur in various components if supporting is incorrectly set are avoided. The individual components can thus have comparatively light and therefore cost-effective dimensioning. Due to the sole articulation of the seat on the upper part and to the supporting of the upper part on the middle part by the second spring element, the weight force can be detected, irrespective of whether it acts on a seat part and/or a back part and/or armrests of the seat. Furthermore, by an inclination movement of the seat being supported by the first spring element and by the spring force of the first spring element being set as a function of the weight force, this ensures a reaction of the seat which is oriented in terms of the weight force which exerts load on the entire seat. The essence of the invention, therefore, is the use of a first spring element for supporting the inclination movement of the seat, the use of a second spring element for detecting the weight force acting on the entire seat and, finally, the variation in the spring force of the first spring element as a function of the weighing distance which brings about the weight force against the second spring element. In one embodiment, the weight-dependent variation in the spring force of the first spring element is brought about by a displaceable support which can be adjusted contactlessly and therefore very smoothly and quickly as a function of the weight of the user, as long as the user does not recline in the seat. Due to the smooth movement of the spring mechanism, even the weight of a light person who sits down slowly and gently can be detected correctly. The weight of a heavy person who lets himself fall into the seat can likewise be detected correctly. The movement converter operates as a link between the weighing mechanism and the spring mechanism.

In one aspect, the invention provides a mechanical and/or electrical and/or electronic and/or pneumatic and/or hydraulic movement converter between the weighing mechanism (WM) and the spring mechanism. This also makes it possible to produce pieces of furniture for special applications, for example for vehicles.

In one aspect, the invention provides, furthermore, for using the middle part and the upper part as components of the movement converter. The movement converter can thereby be constructed cost-effectively with few components.

Furthermore, in one aspect, the invention provides for guiding the support on the curve, the curve running, in the position of rest of the piece of furniture, at an approximately constant spacing with respect to the lever arm or to the leaf spring designed as a lever arm. Owing to the run of the curve, it is possible to take into account a lowering of the lever arm during the traveling movement of the support and therefore to prevent the lever from coming to lie prematurely on the support.

A design variant of the invention provides for the support to move motorized along the curve. A continuous mechanical connection between the weighing mechanism and the spring mechanism may thereby be dispensed with.

According to one aspect of the invention, there is also provision for detecting the weighing distance electrically or electronically. As a result of this, too, a continuous mechanical connection between the weighing mechanism and the spring mechanism may be dispensed with.

In one aspect, the invention provides for articulating the spring element of the spring mechanism on the upper part and for supporting the seat with respect to the upper part. An unfalsified detection of the loading of the seat between the upper part and the middle part is thereby possible.

Furthermore, in one aspect, the invention provides for arranging a height adjustment device between the lower part and the middle part. A conventional height adjustment device can thereby be used, since this is arranged independently of the spring mechanism, the weighing mechanism and the movement converter.

According to a design variant, there is provision for arranging a height adjustment device between the middle part and the upper part. In such an arrangement of the height adjustment device, it is possible to integrate the height adjustment device into the weighing mechanism.

In one aspect, the invention provides solely a vertical component for each weighing movement. Particularly accurate weighing is thereby possible, since even the slightest falsifications are avoided.

A design variant of the invention provides a vertical component and a horizontal component for each weighing movement, the vertical component being greater than the horizontal component. Numerous additional variants are thereby available for the design of the weighing mechanism, a falsification of the weighing result nevertheless being kept within the tolerance range. It is particularly advantageous if the vertical component has at least four times the value of the horizontal component. A measurement error is thereby reduced to an acceptable size.

In one aspect, the invention also provides for implementing the movement converter by a drive body guided movably on the upper part, with a slot, and a pin which is arranged on the middle part and which is guided in or on the slot. It is thereby possible to implement a mechanically smoothly and accurately operating movement conversion in which, for example, a rotational movement is generated and is converted into a sliding movement.

In one aspect, the invention provides for arranging the weighing mechanism centrically with respect to a vertically standing axis of rotation of the piece of furniture. The weighing mechanism can thereby be installed in a space-saving way particularly in swivel chairs.

In particular, in one aspect the invention provides for forming the weighing mechanism by the height adjustment device. A particularly space-saving and cost-effective design is thereby possible, since some components fulfill functions of the height adjustment device and functions of the weighing mechanism.

In one aspect, the invention provides a height adjustment device which comprises a settable spring, an axial bearing and the spring element, the settable spring comprising a pressure tube and a piston rod movable in the latter. In a height adjustment device of this type, the spring element may also assume the function of the spring element of a weighing mechanism.

In one aspect, the invention provides for arranging between the axial bearing and the spring element an adaptor which is designed, in particular, as a cup. A compact design is thereby possible, the cup, together with its slits, serving as a device for fastening at least one movement converter.

The invention provides, in one particular embodiment, a movement converter which comprises at least one Bowden cable and at least one lever mechanism. Owing to a movement converter constructed in this way, a cost-effective and flexible connection between the weighing mechanism and the movement converter is possible.

Furthermore, in one aspect, the invention provides for supplementing the movement converter by a coupling which is arranged on the pressure tube of the settable spring, the coupling comprising a lower ring, an upper ring and an inner ring. The movement converter can thereby be decoupled in a simple way from a rotational movement of the seat about the vertical axis of rotation.

In one aspect, the invention also provides a seat having at least two carriers. As a result, seats of different width can be produced by means of the same components.

Furthermore, in one aspect, the invention provides for equipping each carrier of the seat with a specific spring mechanism, the latter being connected to a specific weighing mechanism via a specific movement converter. As a result, each carrier of the seat can be supported against an inclination movement about its horizontal axis of rotation in accordance with its individual load.

Alternatively, the invention provides for assigning a specific spring mechanism to each carrier and for connecting the spring mechanisms to a central weighing mechanism by means of a movement converter. The piece of furniture can thereby be produced cost-effectively, since only one weighing mechanism is required for controlling the spring mechanisms.

In one aspect, the invention also provides for designing the carriers with an upper leg and a lower leg, the carriers in each case being supported with their upper leg on a spring element of the respective spring mechanism. A space-saving arrangement of the spring mechanism between the legs is thereby possible.

In one aspect, the invention provides, furthermore, for connecting the legs of the carrier to one another by means of spokes. Forces can thereby be transmitted between the legs of a carrier in a directed manner, in order to determine desirably the bending behavior of the carrier.

The piece of furniture according to the invention comprises a weighing mechanism which is formed by a height adjustment device, the height adjustment device comprising a settable spring with a pressure tube and with a piston rod movable in the pressure tube, an axial bearing and a spring element, the weighing mechanism having a device for fastening a movement converter. A height adjustment device modified in this way can also be used as a weighing mechanism to which a movement converter can be connected.

BRIEF DESCRIPTION OF THE DRAWINGS

Further details of the invention are described by means of exemplary embodiments illustrated diagrammatically in the drawing in which.

DETAILED DESCRIPTION OF THE PREFERRED EMBODIMENTS

Figure 1B:
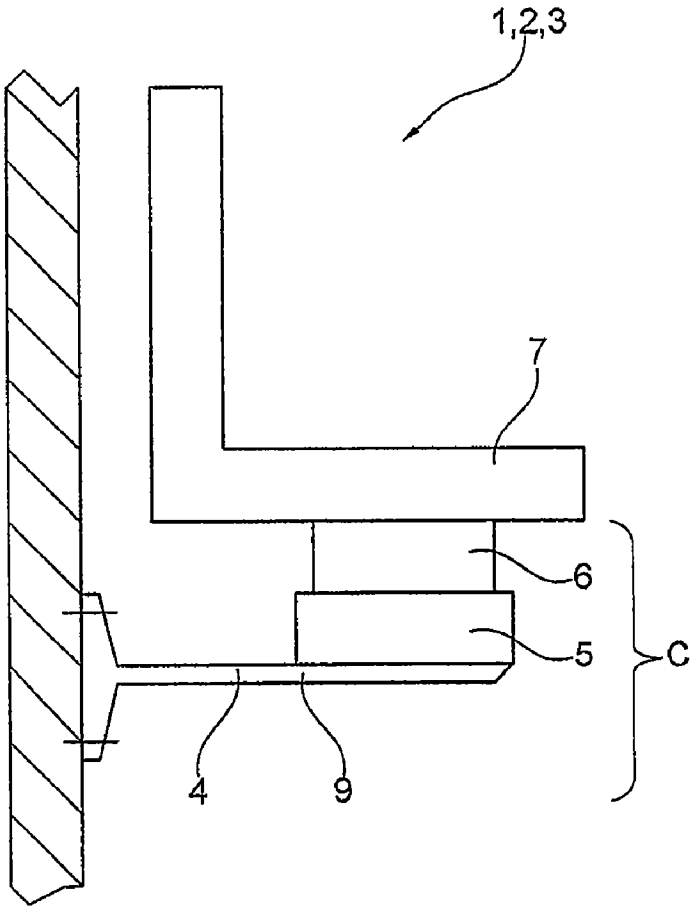
FIGS. 1*a*-1*d* show diagrammatic views of four basic variants of a piece of furniture designed as a chair.
Figure 1A:
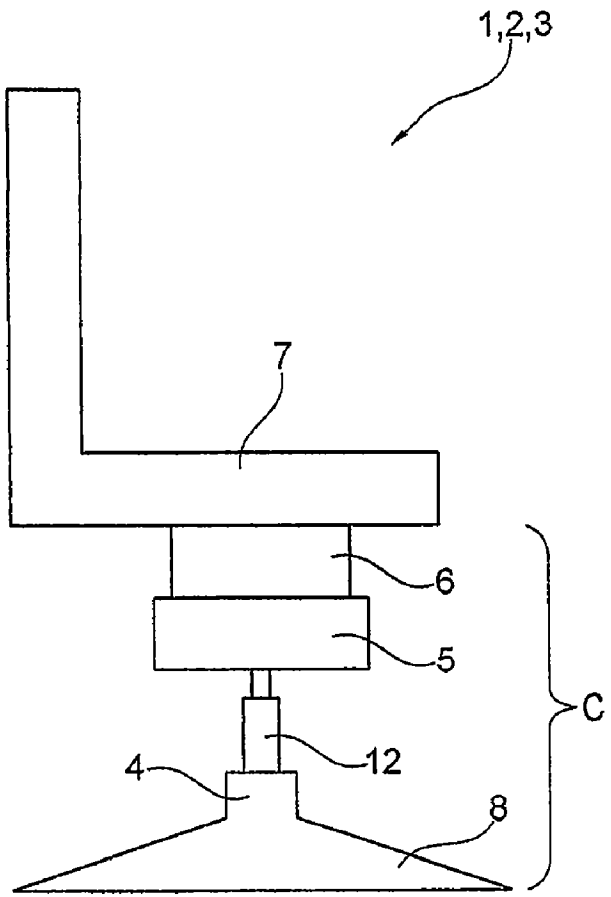
Figure 1D:
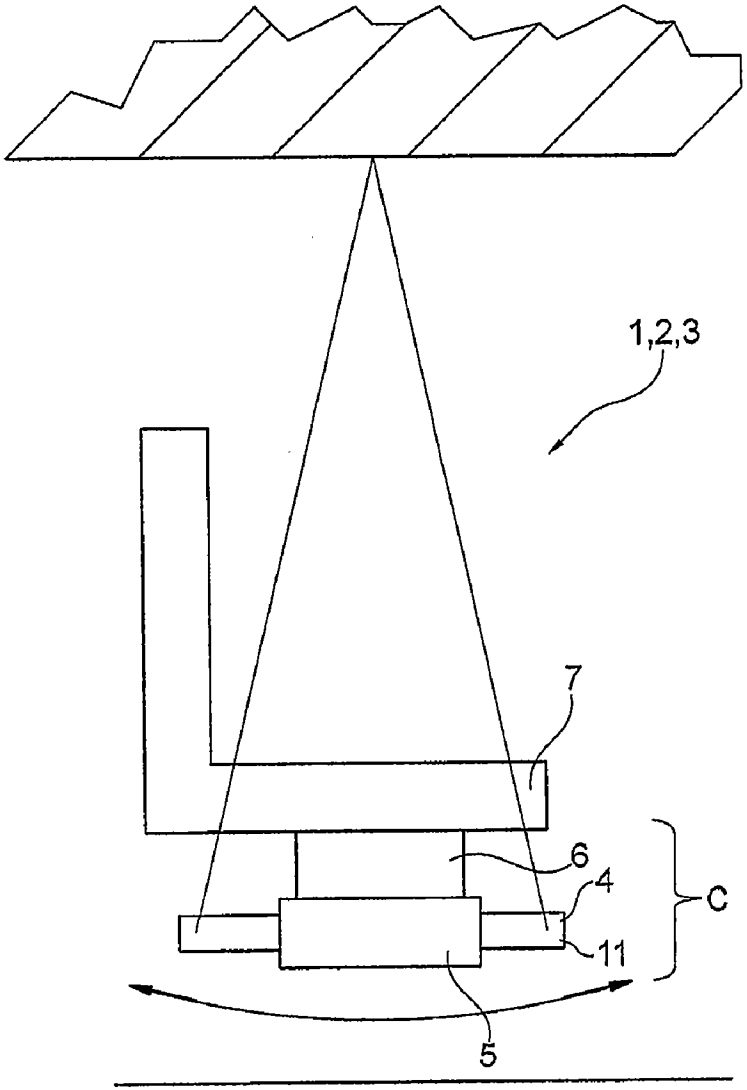
Figure 1C:
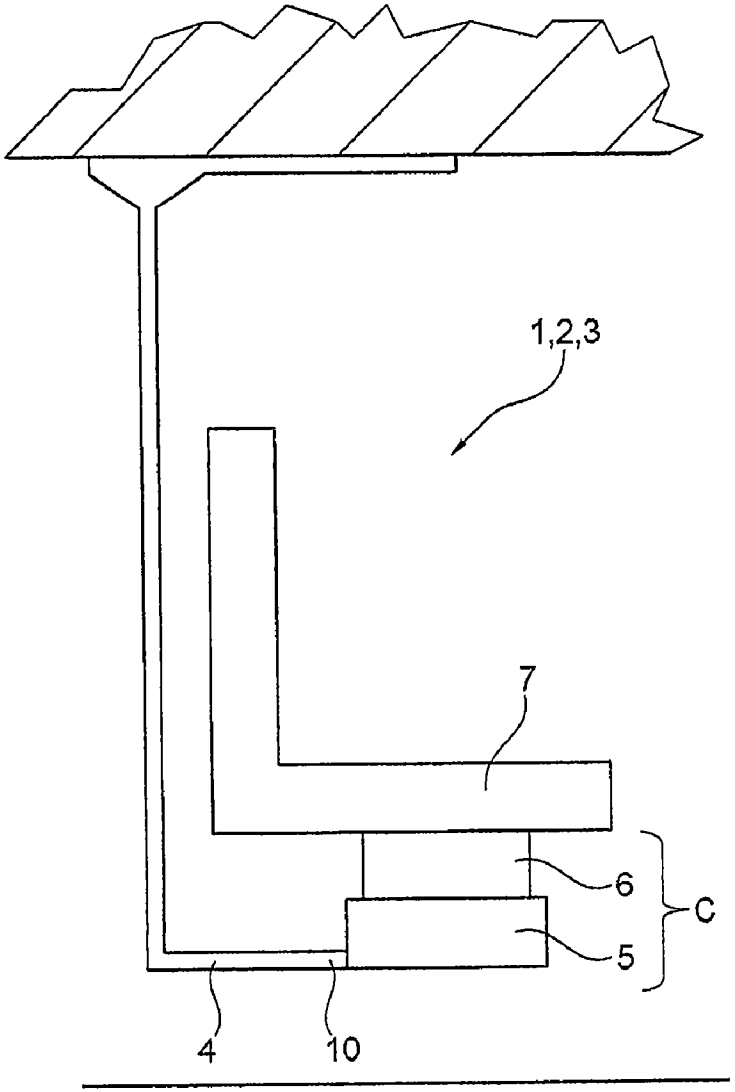

FIGS. 1*a* to 1*d* illustrate four basic variants of a body support structure 1 according to the invention, which are shown for example and without limitation as a piece of furniture for sitting on 2 in the form of a chair 3. All four pieces of furniture 1 comprise essentially a lower part 4, a middle part 5, an upper part 6 and a seat 7. It should be understood that the invention can also be incorporated, without limitation, into other body support structures such as beds, sofas, benches, vehicle and/or aircraft seats, etc. All the components 4, 5, 6 carrying the seat 7 are also designated in summary as a base C. The seat 7 is in each case articulated on the upper part 6 which is connected to the middle part 5. The middle part 5 is carried by the lower part 4. The lower part 4 is designed in FIG. 1*a* as a foot 8, in FIG. 1*b* as a wall holder 9, in FIG. 1*c* as a ceiling holder 10 and in FIG. 1*d* as a swing 11. FIG. 1*a* also shows, in principle, the arrangement of a height adjustment device 12 between the lower part 4 and the middle part 5.

Figure 1E:
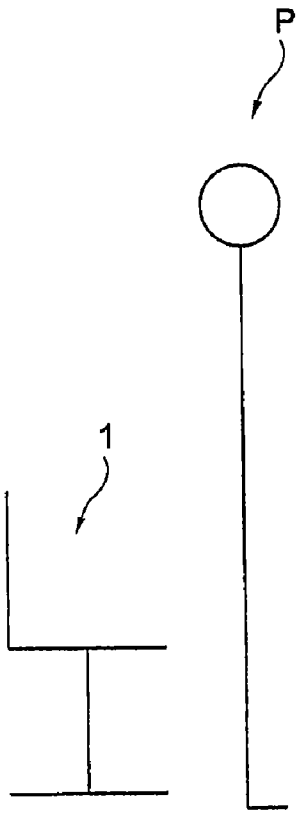
FIGS. 1*e*-1*h* show diagrammatic views of a standing and sitting person.
Figure 1F:
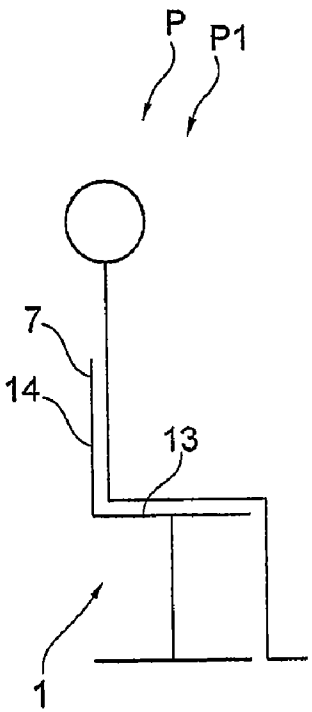
Figure 1G:
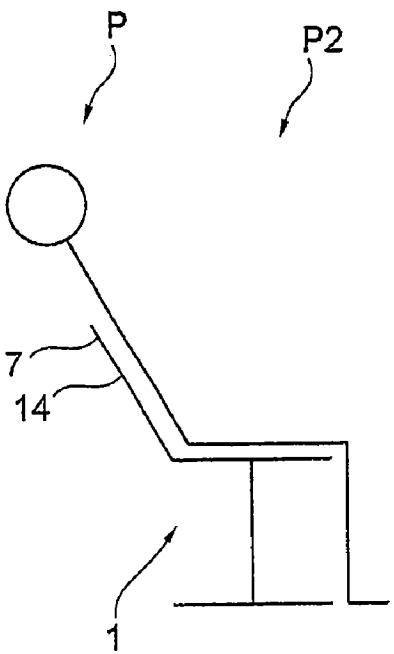
Figure 1H:
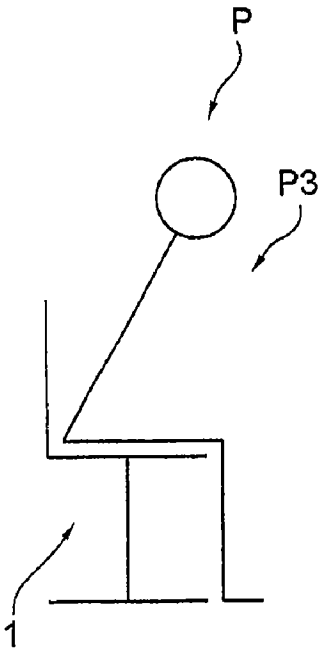

FIGS. 1*e* to 1*h* show diagrammatic views of a person P and of a piece of furniture 1. In FIG. 1*e*, the person P is standing in front of the piece of furniture 1. In FIG. 1*f*, the person P is sitting upright in an upright sitting posture P1 on a seat part 13 of a seat 7 of the piece of furniture 1 and in this case subjects a back part 14 of the seat 7 to no or only insignificant load. In FIG. 1*g*, the sitting person P reclines backward into a rearwardly inclined sitting posture P2 and in this case experiences a counterforce due to the back part 14 of the seat 7 of the piece of furniture 1. In FIG. 1*h*, the person P leans forward into a forwardly inclined sitting posture P3.

Figure 2B:
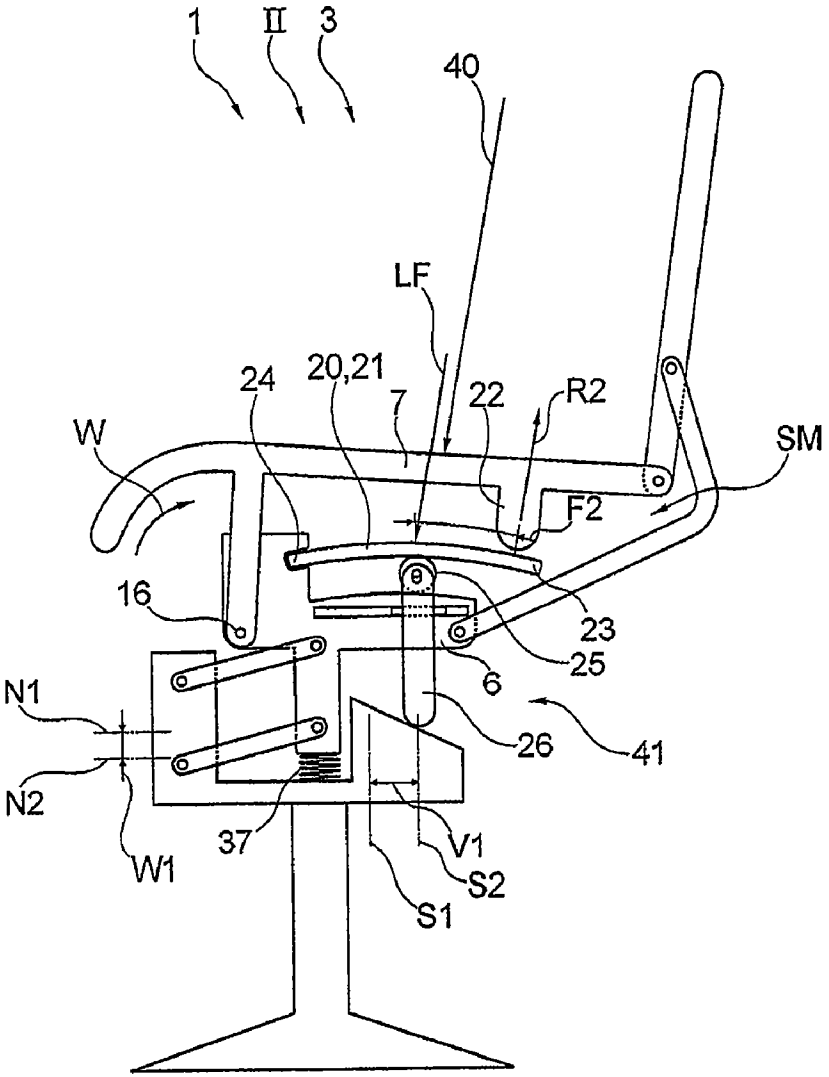
FIGS. 2*a*-2*c* show a diagrammatic illustration of a piece of furniture according to the invention in two positions.
Figure 2A:
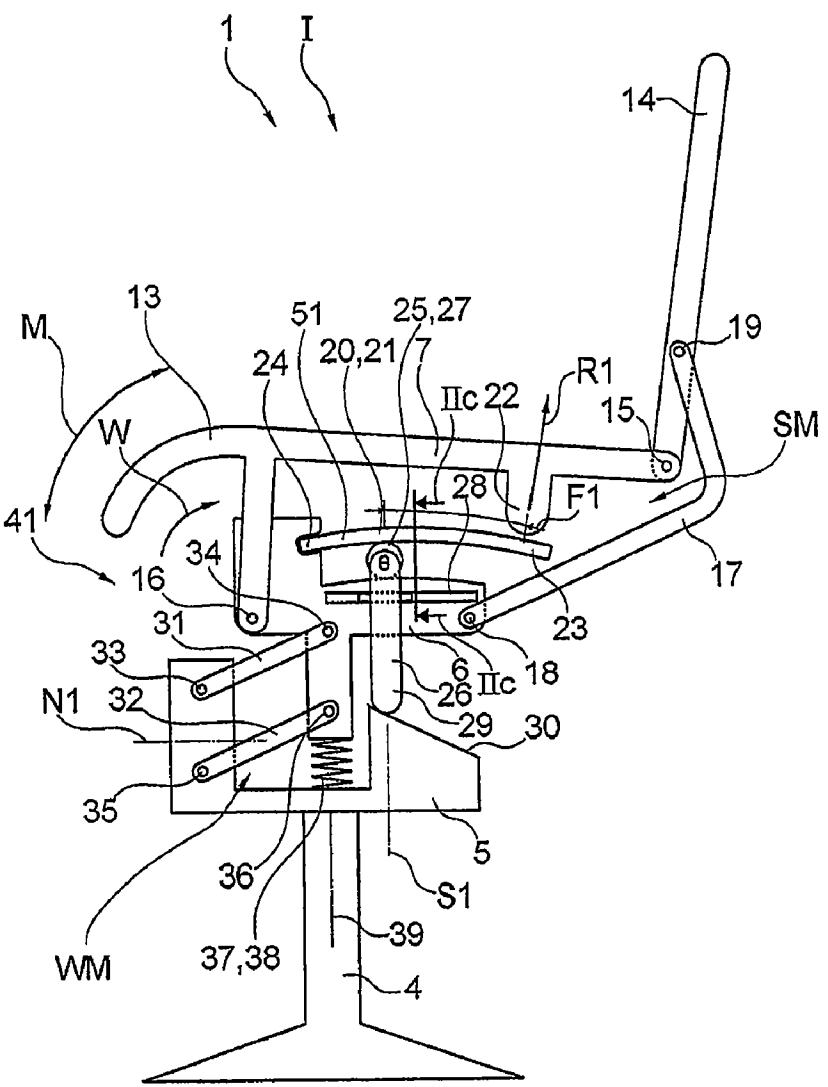

FIGS. 2*a* and 2*b* show diagrammatic illustrations of a piece of furniture 1 according to the invention in two positions I (see FIG. 2*a*) and II (see FIG. 2*b*). The piece of furniture 1 comprises a lower part 4, a middle part 5, an upper part 6 and a seat 7. The seat 7 comprises a seat part 13 and a back part 14 which are connected to one another in an articulated manner by means of an axis of rotation 15. The seat part 13 is articulated rotatably with an axis of rotation 16 on the upper part 6, and the back part 14 is guided via an arm 17 with an axis of rotation 18 on the upper part 6, the arm 17 also being connected rotatably with an axis of rotation 19 to the back part 14. A first spring element 20 designed as a leaf spring 21 is fastened to the upper part 6. The first spring element 20 extends as a lever arm 51 approximately horizontally beneath the seat part 13 of the seat 7, and the seat part 13 lies with a projection 22 on the first spring element 20 in the region of a free end 23 of the latter. The first spring element 20 has a prestress and is supported between a tension end 24 and the free end 23 by a support 25 only when there is a corresponding load. The support is held by a slide 26. The support 25 and the spring element 20 form a spring mechanism SM. The support 25 is designed as a roller 27. The slide 26, which carries the support 25, is guided laterally movably in a guide 28 on the upper part 6 and lies with a lower end 29 on an inclined plane 30 of the middle part 5. The upper part 6 is guided movably upward and downward on the middle part 5 via two arms 31, 32 oriented parallel to one another, the arms 31, 32 being connected in each case to the middle part 5 and the upper part 6 rotatably about axes of rotation 33 to 36 running into the drawing plane. The downward movement or the upward movement of the upper part 6 together with the seat 7 is braked or assisted by a second spring element 37. The second spring element 37 is arranged between the upper part 6 and the middle part 5 and is designed as a helical spring 38. The spring element 37 and the arms 31 and 32 form a weighing mechanism WM. Finally, the middle part 5 is mounted on the lower part 4 rotatably about a vertical axis of rotation 39.

In FIG. 2*a*, which shows the piece of furniture 1 in the position I, the piece of furniture 1 or the seat 7 is nonloaded and is in a position of rest. That is to say, no person is sitting on the piece of furniture 1. The upper part 6 therefore stands at a level N1 at which the second spring element 37 has to compensate only the weight of the upper part 6 and of the seat 7. In this position I of the piece of furniture 1, the slide 26 stands in a left position S1. A supporting of an inclination movement of the nonloaded seat 7 about the axis of rotation 16 in a direction of rotation w on the projection 22 takes place via the first spring element which is not in contact with the support 25. The nonloaded piece of furniture 1 according to the invention has to generate by means of its first spring element 20 only a comparatively low reaction force R1 to an inclination of the seat 7 about the axis of rotation 16 in the direction of rotation w, since, in this situation, only a torque M generated due to the dead weight of the seat 7 is to be absorbed. Basically, an interspace 95 having a thickness D95 lies between the support 25 or its contact surface KF and the first spring element 20 or the leaf spring 21 (see FIG. 2*c* with a diagrammatic sectional view along the sectional line IIc-IIc illustrated in FIG. 2*a*). This interspace 95 is brought about by a prestress of the leaf spring 21 which is selected such that the leaf spring 21 stands with play above the contact surface KF of the support 25 and a movement of the support 25 can take place according to a weight force 40 (see FIG. 2*b*), without the leaf spring 21 impeding or braking the support 25.

In FIG. 2*b*, which shows the piece of furniture 1 in the position II, the piece of furniture 1 or the seat 7 is loaded by the weight force 40 of a person, not illustrated, sitting upright and is in a working position. The upper part 6 is lowered to a level N2 at which the second spring element 37 has to compensate the weight of the upper part 6, the weight of the seat 7 and the weight force 40. In this position II of the piece of furniture 1, the slide 26 is in a middle position S2 and with its support 25 supports the first spring element 20 between its tension end 24 and its free end 23, insofar as the person leans backward and thereby increases the loading of the spring element 20. An increased reaction force R2 is available for supporting an inclination movement of the person together with the seat 7 about the axis of rotation 16 in a direction of rotation w as soon as the leaf spring 21 comes to lie on the support 25 as a result of the displacement of the person and engages said support 25 under itself with a engaging force LF. Thus the support 25 is clamped by a clamping force in its actual position. The loaded piece of furniture 1 according to the invention thus generates a reaction force R2 to an inclination of the seat 7 about the axis of rotation 16 in the direction of rotation w. The reaction force R2 is higher than the reaction force R1 due to an additional support of the leaf spring 21 on the support 25 and is thus adapted to the loading of the piece of furniture 1. As soon as the person sitting on the piece of furniture 1 resumes an upright sitting position, this also gives rise in the position II to an interspace 95, shown in FIG. 2*c* for the position I, between the leaf spring 21 and the support 25 or its contact surface KF. That is to say, the piece of furniture 1 regains the smooth movability of the support 25 with respect to the leaf spring 21 as soon as the person changes from a reclined sitting position into an upright sitting position. Between the position I and the position II, the spacings F1, F2 between the support 25 and the projection 22 vary as a function of the person's weight.

The difference between the levels N1 and N2 of the upper part 6 in positions I and II is designated as the weighing distance W1, and the spacing between the positions S1 and S2 of the slide 26 is designated as the displacement distance V1.

The upper part 6 and the middle part 5 thus form with one another a movement converter 41 which converts the weighing movement against the second spring element 37 into a displacement movement, by which the first spring element 20 is influenced in its reaction force R1 or R2 on the seat 7. The second spring element 37 or the spring mechanism SM is influenced as a function of the weighing movement, although the weighing movement cannot be influenced by an inclination movement of a person sitting on the piece of furniture 1 and reclining. The weight force 40 of the person is detected completely, independently of his position on the seat 7, solely due to the articulation of the seat 7 on the upper part 6. The seat 7, shown in FIGS. 2*a* and 2*b*, is designed in the manner of a known synchronous mechanism which, when a person reclines in the seat 7, gives rise to a different increase or decrease in the inclination of the seat part 13 or of the back part 14. The arms 32, 33 and the spring element 37 form the weighing mechanism WM by means of which the weight force 40 of a person sitting on the seat can be detected. The weighing mechanism WM gives rise via the movement converter 41 to a setting of a spring mechanism SM according to the weight force 40 of the person using the piece of furniture 1. The spring mechanism SM is formed essentially by the first spring element 20 or the leaf spring 21 and the support 25, the support 25 cooperating with the leaf spring 21 only when a person sitting on the piece of furniture 1 reclines into a rearwardly inclined sitting position P2 described in FIG. 1*g*.

Figure 2C:
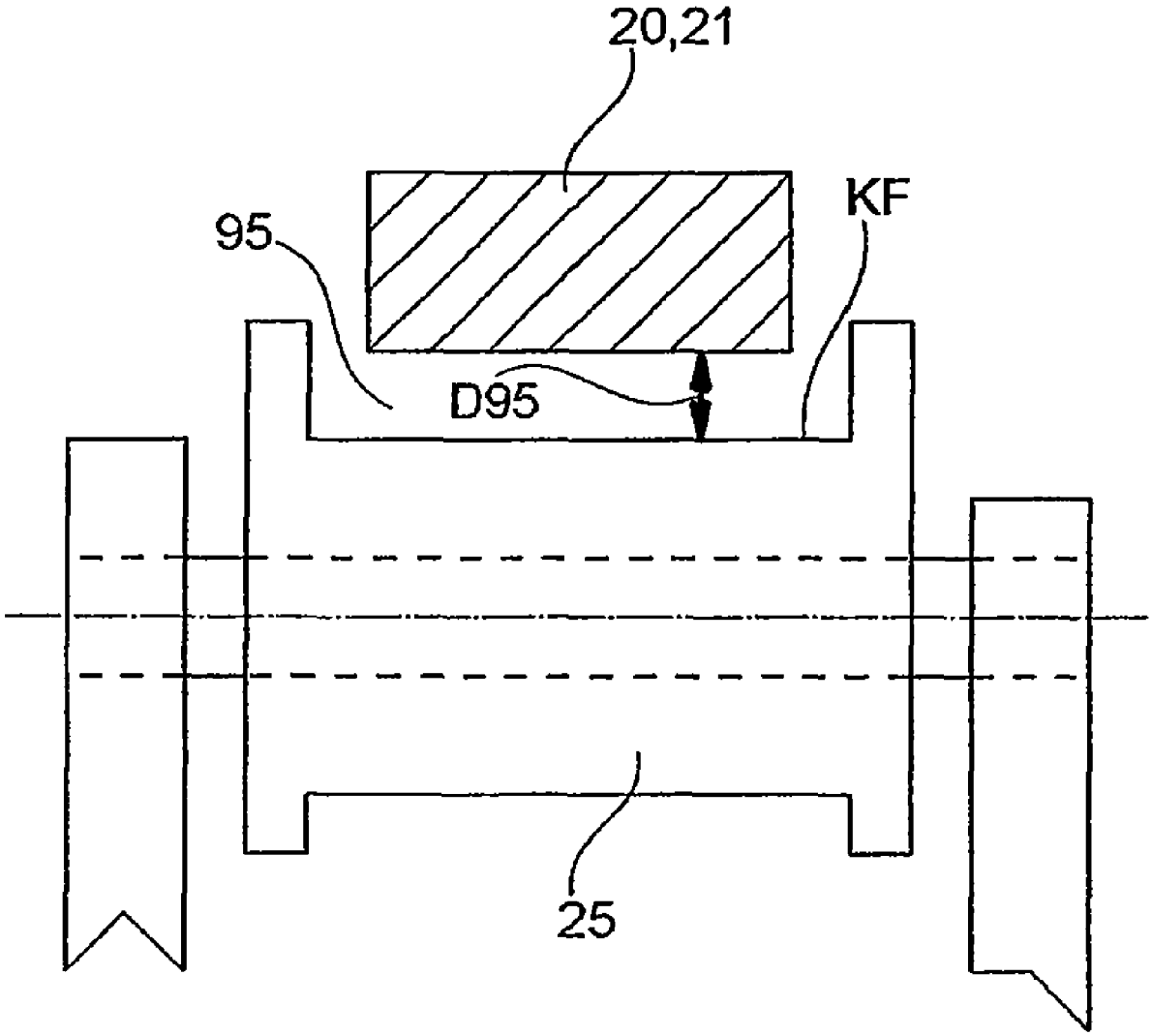
Figure 3:
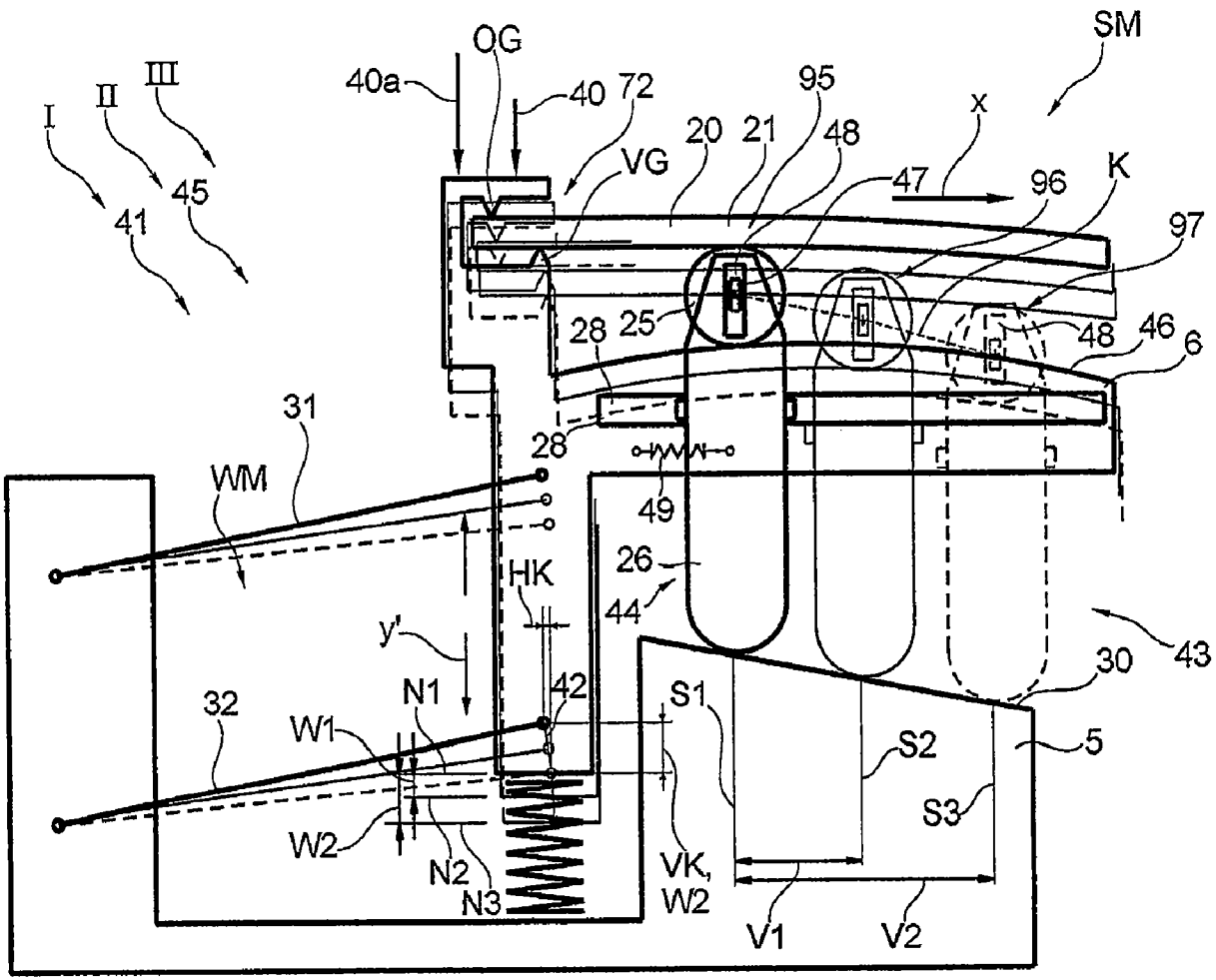
FIG. 3 shows an enlarged illustration of a weighing mechanism, a spring mechanism and a movement converter of a piece of furniture according to the invention.

FIG. 3 illustrates a diagrammatic view of a movement converter 41 which is constructed in a similar way to the movement converter shown in FIGS. 2*a* to 2*c* and is arranged between a weighing mechanism WM and a spring mechanism SM. For simplification, an upper part 6 is shown here without articulation points for a seat.

The movement converter 41, the weighing mechanism WM and the spring mechanism are illustrated in three positions I, II and III. In position I, shown by thick unbroken lines, the arrangement is nonloaded. The arrangement is therefore not loaded by a person sitting on the seat, not illustrated. When the arrangement is loaded via the seat, not illustrated, with a first weight force 40 of a first person, the upper part 6 is lowered counter to a second spring element 37 in the direction of an arrow y' downward toward a middle part 5 into the second position II. The second position II is illustrated by thin unbroken lines. Lowering takes place according to the articulation of the upper part 6 on the middle part 5 via two parallel arms 31 and 32 on a circular path 42.

When the arrangement is loaded via the seat, not illustrated, with a second weight force 40*a* of a second person which is greater than the first weight force, the upper part 6 is lowered counter to the second spring element 37 in the direction of the arrow y' downward toward the middle part 5 into the third position III. The third position III is illustrated by thin broken lines. Lowering again takes place according to the articulation of the upper part 6 on the middle part 5 via two parallel arms 31 and 32 on the circular path 42. In positions I and II, the upper part has levels N1 and N2, the difference of which corresponds to a weighing distance W1. This weighing distance W1 is converted via a drive 43 and an output 44 into a displacement distance V1 which is defined as a path difference between positions S1 and S2 of a slide 26. The drive 43 comprises a guide 28 on the upper part 6 and an inclined plane 30 on the middle part 5. These two components give rise, due to a lowering of the guide 28 together with the upper part 6, to a lateral displacement movement of the slide 26 which forms the output 44. In other words, the upper part 6, together with the middle part 5 or with the transmission mechanism operating as a movement converter 41, forms a gear 45 for converting a weighing movement into a displacement movement. In positions I and III, the upper part has the level N1 and a level N3, the difference of which corresponds to a weighing distance W2. This weighing distance W2 is converted via the gear 45 into a displacement distance V2 which is defined as the path difference between the position S1 and a position S3 of the slide 26. The slide 26 slides in the guide 28 from the position S1 into the position S2, a support 25, fastened vertically movably to the slide 26, for a first spring element 20 moving on the upper part 6 along a curved path 46 which runs at an approximately constant spacing with respect to a curved run of the first spring element 26 designed as a leaf spring 21. By the path 46 being coordinated with the run of the leaf spring 21, it is possible to avoid a jamming of the support 25 under the spring element 20 in any position of the support 25 or slide 26 and to ensure a smooth movement of the support 25. The smooth movement of the support 25 is implemented by the formation of an interspace 95, 96 and 97 in any position of the support 25, insofar as the piece of furniture 1 is not loaded by a reclining person. As regards the structural implementation of the interspaces, reference is made to FIG. 2*c* which has similar validity for FIG. 3. Owing to the smooth moveability which the support achieves as soon as the person sitting on the chair assumes an upright sitting position, a sensitive readjustment of the position of the support 25 is also possible if, for example, the person using the chair grasps a heavy file and puts this down again later. The vertical moveability of the support 25 is achieved by the guidance of a shaft 47 of the support 25 in long holes 48 arranged on the slide 26. As a result, during the displacement of the slide 26, the support 25 can follow the path 46 independently of the run of the guide 28. In the position S3 of the slide 26, belonging to position III, the support 25 has been lowered, according to the run of the path 46, in the direction y' downward in the long holes 48. The path 46 is configured in its run in such a way that an undesirable jamming of the support 25 between the path 46 and the leaf spring 21 during weighing is prevented. The run of the path 46 is adapted to the run of the leaf spring 21. A return of the slide 26 out of the position S3 or S2 into the position S1 takes place, when the seat is relieved of the weight force acting on it, for example, by means of a tension spring 49 which connects the slide 26 to the upper part 6. Such a tension spring 49 is also provided, for example, for the pieces of furniture illustrated in FIGS. 2*a* and 2*b*. As already mentioned in the description of FIGS. 2*a* and 2*b*, the displacement of the support 25 influences the hardness of the leaf spring 21 with which the latter supports an inclination movement of a seat, not illustrated, on the upper part 6. In the nonloaded position I, the first spring element 20 basically already has a prestress, by means of which the seat, not illustrated, is already supported against a basic loading of the piece of furniture with, for example, 40 kg. Such a prestress is generated in a tension slit 72 for the leaf spring 21 by the leaf spring 21 being fixed between an upper counterbearing OG and a lower counterbearing UG. In a consideration of the lower counterbearing UG and the support 25, the lower counterbearing UG is to be defined as a first support and the support 25 as a second support for the leaf spring 21.

Furthermore, with regard to the weighing movement on the circular path 42, FIG. 3 depicts a vertical component VK of the weighing movement and a horizontal component HK of the weighing movement. In the case depicted, the vertical component VK of the weighing movement corresponds to the weighing distance W2. In the present case, the vertical component VK is substantially greater than the horizontal component HK. Thus, the weighing result, while having the required accuracy, is falsified at most minimally.

Figure 4A:
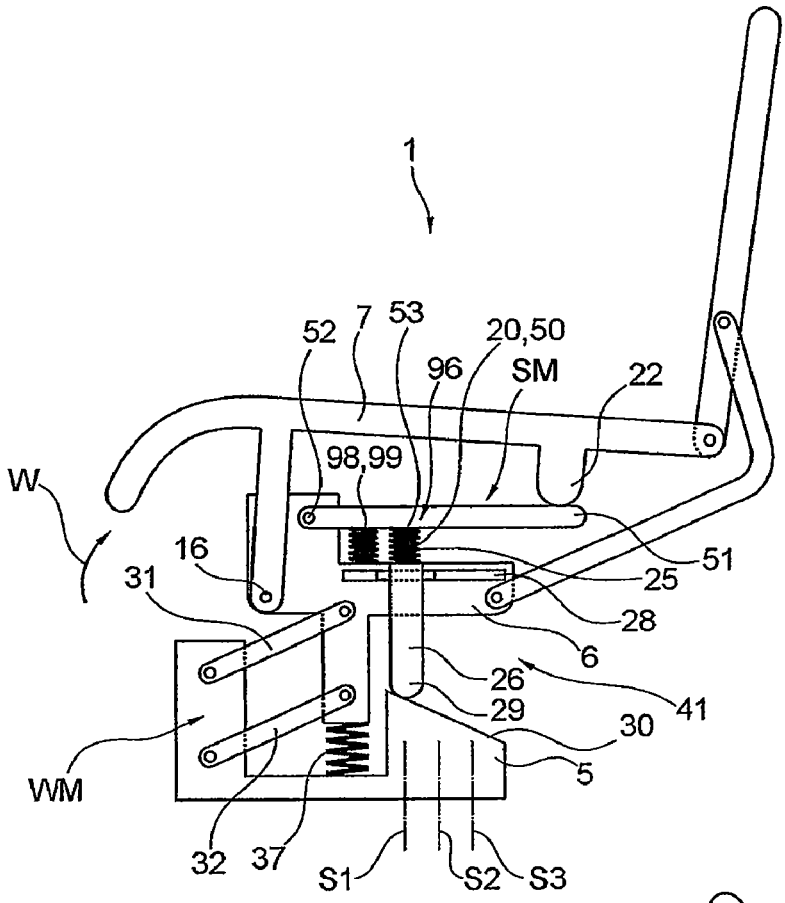
FIGS. 4*a*-4*c* show diagrammatic illustrations of further design variants of a piece of furniture according to the invention.
Figure 4B:
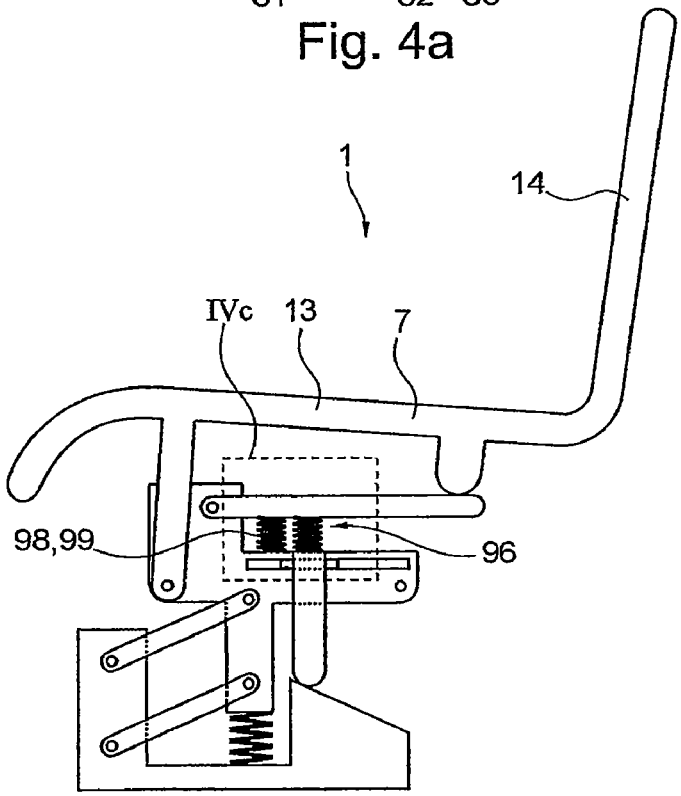
Figure 4C:
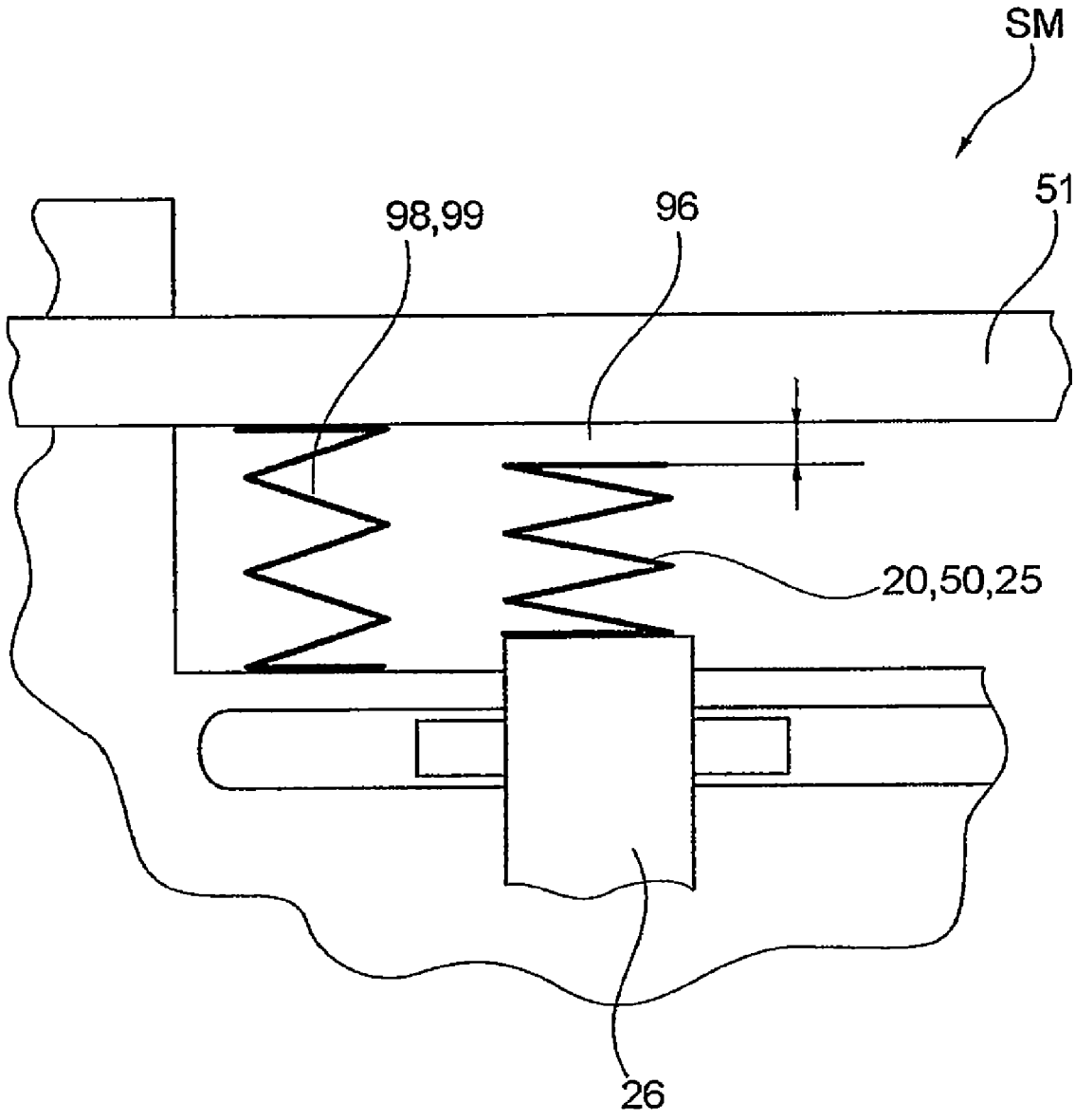

FIGS. 4*a* and 4*b* show two variants of a piece of furniture 1 in a diagrammatic illustration. In both variants, the illustration of a lower part of the piece of furniture 1 has been dispensed with. FIG. 4*a* shows a middle part 5 which carries an upper part 6 via two arms 31 and 32. A seat 7 is articulated on the upper part 6 by means of a synchronous mechanism already described with regard to FIGS. 2*a* and 2*b*. In contrast to the pieces of furniture described above, a first spring element 20, which supports an inclination movement or rotational movement of the seat 7 about an axis of rotation 16 in a direction of rotation w, is designed as a helical spring 50 which is arranged on a slide 26. The slide 26 is guided, in a similar way to the designs shown in FIGS. 2*a* to 3, on the upper part 6 in a guide 28 and slides with a lower end 29 on an inclined plane 30 which is formed on the middle part 5. The upper part 6 guided upward and downward on the middle part 5 on arms 31 and 32 is supported against the middle part 5 by means of a second spring element 37. Between a projection 22 of the seat 7 and the first spring element 20 is arranged a lever 51 which is articulated on the upper part 6 rotatably about an axis of rotation 52. The seat 7 is supported from above on the lever 51 via a projection 22. The lever 51 is supported, in turn, by the first spring element 20 acting against the lever 51 from below as a support 25, when a person, not illustrated, sitting on the piece of furniture 1 reclines. As long as the person sitting on the piece of furniture 1 does not recline, the lever 51 is sufficiently supported by the force of a spring 98 which is designed as a helical spring 99. Owing to the spring 98, during a traveling movement of the first spring element 20 there is always an interspace 96 between the first spring element 20 and the lever 51, insofar as the person sitting on the piece of furniture 1 does not recline. FIG. 4*c* illustrates, in this regard, a view of a detail, designated in FIG. 4*b* as IVb, which applies to FIGS. 4*a* and 4*b*. The lever 51, the spring 50 and the spring 98, together with a spring mechanism SM, and the arms 31, 32 and the spring 37 thus form a weighing mechanism WM. A movement converter 41 connecting the weighing mechanism WM and the spring mechanism SM is designed according to the movement converter shown in FIGS. 2*a* and 2*b*. As a function of a position S1, S2 or S3 of the slide 26 together with the first spring element 20, different engagement points 53 of the first spring element 20 operating as a support 25 give rise on the lever 51 to a supporting force of differing magnitude against an inclination of the seat 7 about the axis of rotation 16. The description relating to FIG. 4*a* applies likewise to the piece of furniture 1 shown in FIG. 4*b*. The only difference from FIG. 4*a* is that, here, a seat part 13 and a back part 14 of the seat 7 stand at a fixed angle to one another.

Figure 5B:
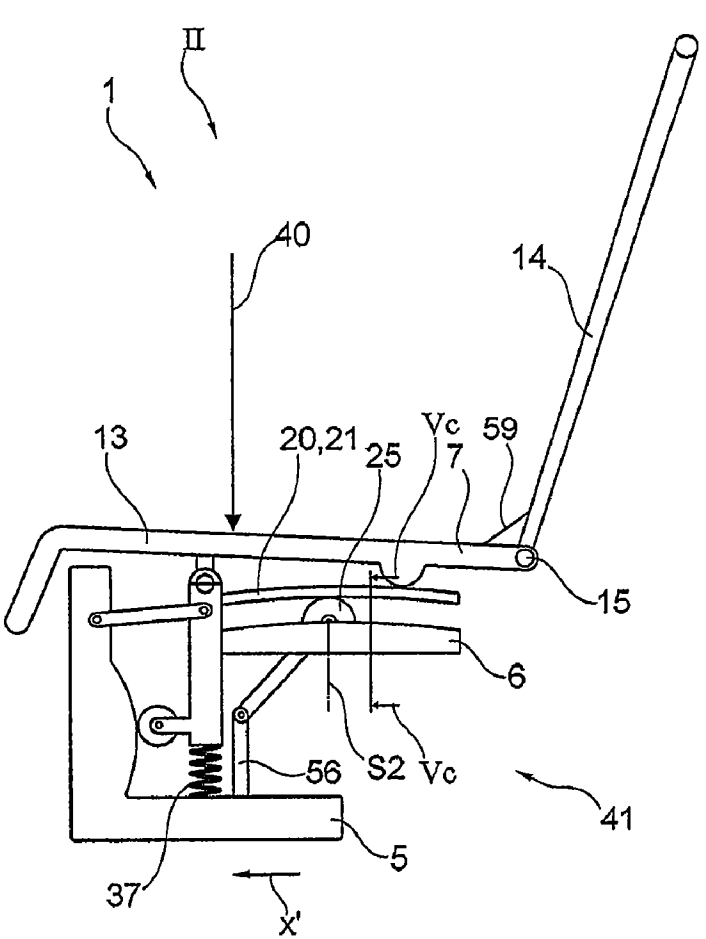
FIGS. 5*a*-5*c* show a diagrammatic illustration of a further piece of furniture according to the invention in a nonloaded and a loaded position.
Figure 5A:
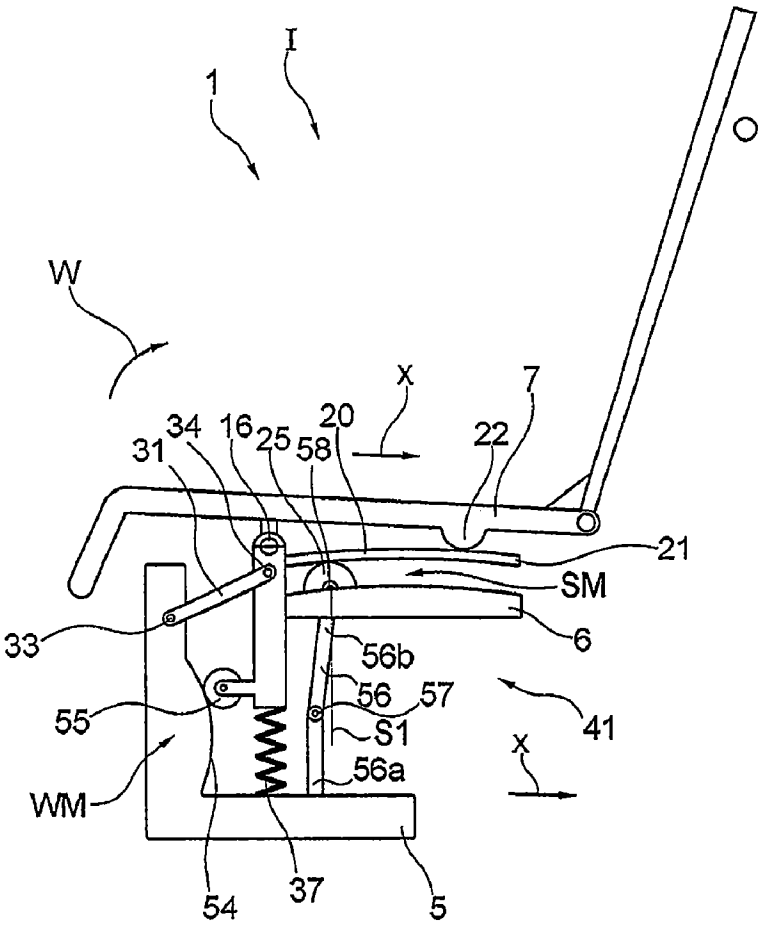
Figure 5C:
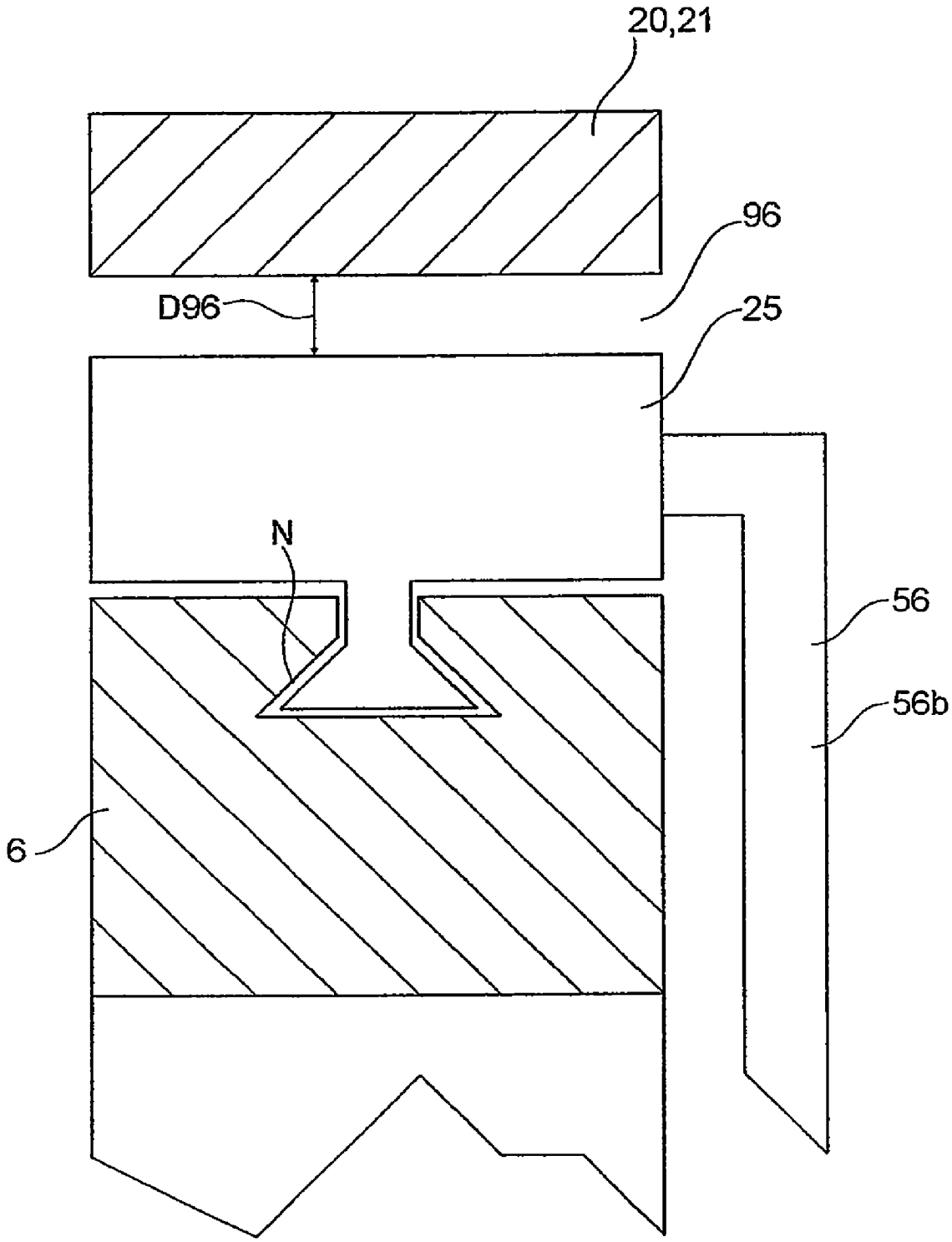

FIGS. 5*a* and 5*b* show a further design variant of a piece of furniture 1 according to the invention in two different positions I and II, the illustration of a lower part of the piece of furniture 1 having been dispensed with in both figures. An upper part 6 is guided movably upward and downward on a middle part 5 by means of an arm 31 rotatably about axes of rotation 33, 34 and a roller 55 guided on a cam 54 and is supported on the middle part 5 via a second spring element 37. Arranged on the upper part 6 is a first spring element 20, on which a seat 7 articulated on the upper part 6 rotatably about an axis of rotation 16 is supported with a projection 22 against an inclination movement about the axis of rotation 16 in a direction of rotation w. A displacement of a support 25 under the first spring element 20 designed as a leaf spring 21 is achieved by means of a movement converter 41 which connects a weighing mechanism WM and a spring mechanism SM to one another. The movement converter 41 comprises an articulated lever 56 which is composed of a lower lever 56*a* and an upper lever 56*b*. The lower lever 56*a* is connected fixedly to the middle part 5 and is connected to the upper lever 56*b* in a rotationally articulated manner about an axis of rotation 57. The upper lever 56*b* carries the support 25 which is articulated on this rotatably about an axis of rotation 58. A lowering of the upper part 6 together with the seat 7 as a result of loading of the seat 7 by a weight force 40 causes a displacement movement of the support 25 out of a position S1 into a position S2, said displacement movement being caused by the articulated lever 56. The movement converter 41 converts a weighing movement of the upper part 6, in which the support 25 is taken up on the upper part 6, into a displacement movement directed laterally in the direction of an arrow x. In the position II of the piece of furniture 1, as illustrated in FIG. 5*b*, the support 25 stands in the position S2 as a result of the loading of the seat 7 with the weight force 40 and causes the seat 7 to be supported against an inclination movement according to the weight force. When the piece of furniture 1 is relieved of the weight force 40, the second spring element 37 raises the upper part 6, together with the seat 7, and the support 25 is retracted by the articulated arm 56 in the direction of an arrow x' into the position I shown in FIG. 5*a*. The seat 7 is composed of a seat part 13 and of a back part 14, the back part 14 being articulated resiliently on the seat part 13 via an elastic element 59. In the seat 7 illustrated in FIGS. 5*a* and 5*b*, therefore, essentially an inclination movement of the seat part 13 is supported by the first spring element 20. The back part 14 can spring back even further, independently of this, about an axis of rotation 15 of the seat 7. The cooperation of the support 25, of the upper part 6 and of the leaf spring 21 is shown as a detail in FIG. 5*c* according to the section Vc-Vc marked in FIG. 5*b*. As in the previous exemplary embodiments, the support 25 and the leaf spring 21 are spaced apart from one another due to an interspace 96 having a thickness D96, as long as a person sitting on the piece of furniture 1 does not recline. The support 25 is guided in a slot N on the upper part 6.

FIGS. 6*a* to 6*e* illustrate diagrammatically further design variants of weighing mechanisms WM and movement converters 41 for pieces of furniture 1 according to the invention. The arrangement shown in FIG. 6*a* comprises a middle part 5 and an upper part 6, the upper part 6 being guided movably upward and downward in a bore 60 in the middle part 5. The upper part 6 is seated with a column 61 in the bore 60, the column 61 having a duct 62 which opens toward the bore 60 and leads into a boom 63 of the upper part 6. The duct 62 is provided for conducting a hydraulic fluid 64 out of a reservoir 65, formed by the bore 60, through the duct 62 into the boom 63 as a function of a weight force, acting on the upper part 6, of a person, not illustrated, sitting on a seat articulated on the upper part 6. In the boom 63, the hydraulic fluid 64 acts on a piston 66 which is supported against the upper part 6 by means of a second spring element 37. The piston 66 carries a support 25 which is displaceable on a path 46 beneath a first spring element 20 and which determines the counterforce of the first spring element 20 against an inclination movement of the seat, not illustrated. When the seat is relieved of the weight force, the hydraulic fluid is pressed back through the duct 62 into the reservoir 65 by the piston 66 onto which the second spring element 37 presses. The upper part 6 together with the seat is raised by means of the hydraulic fluid 64 which then presses onto a piston surface 67 of the column 61.

Figure 6A:
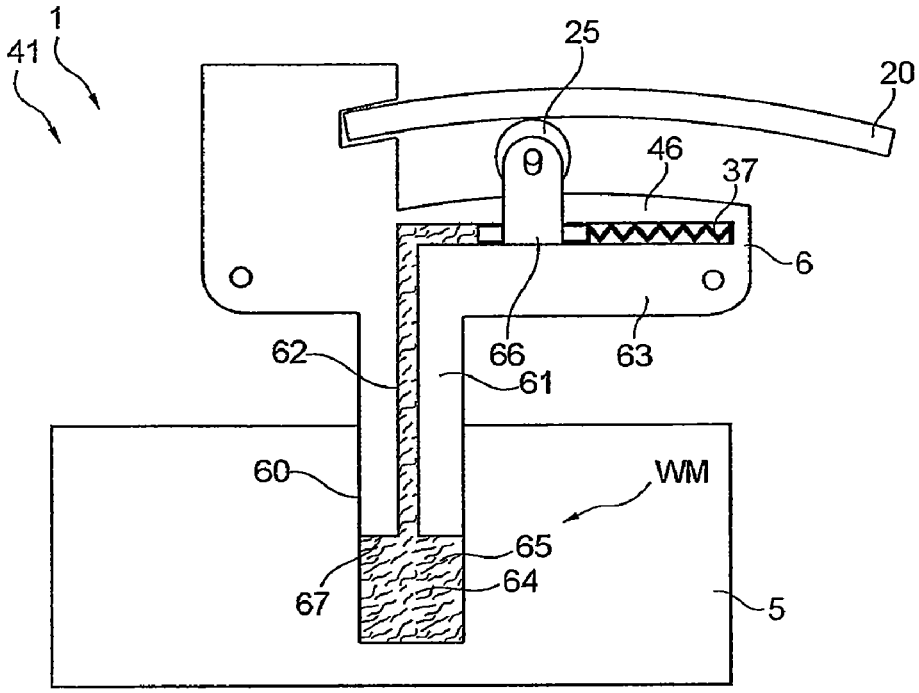
FIGS. 6*a*-6*e* show five variants of a weighing mechanism, a spring mechanism and a movement converter of a piece of furniture according to the invention.
Figure 6B:
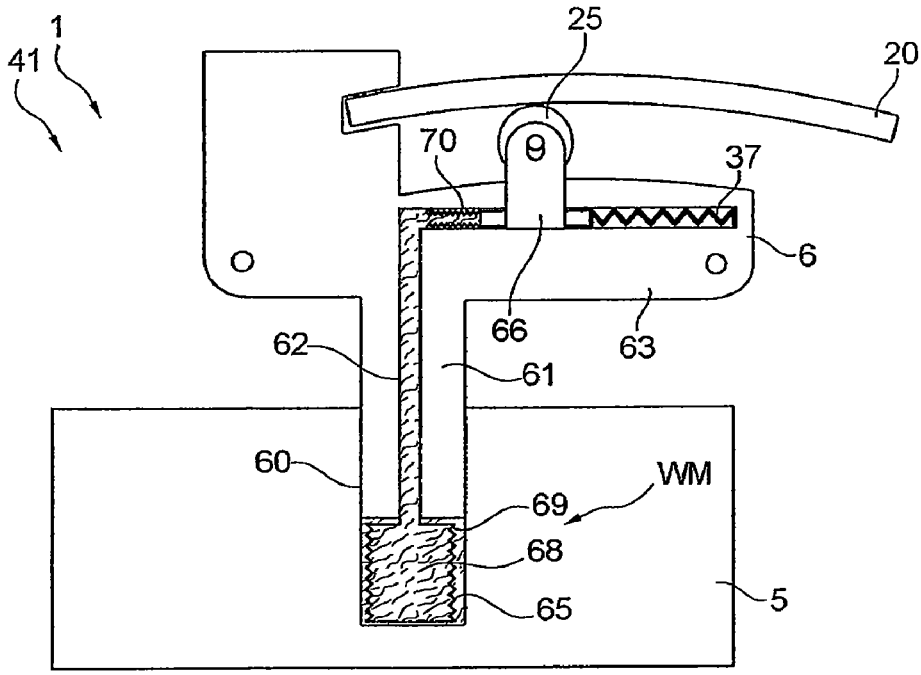

The design variant, illustrated in FIG. 6*b*, of a weighing mechanism WM and a movement converter 41 has an operating mode and design comparable to the arrangement shown in FIG. 6*a*. In contrast to this, here, the force transmission medium used is a magnetorheological fluid 68 which is guided in the reservoir 65 and in the duct 62 in concertinas 69 and 70 in order to ensure optimal sealing off.

Figure 6C:
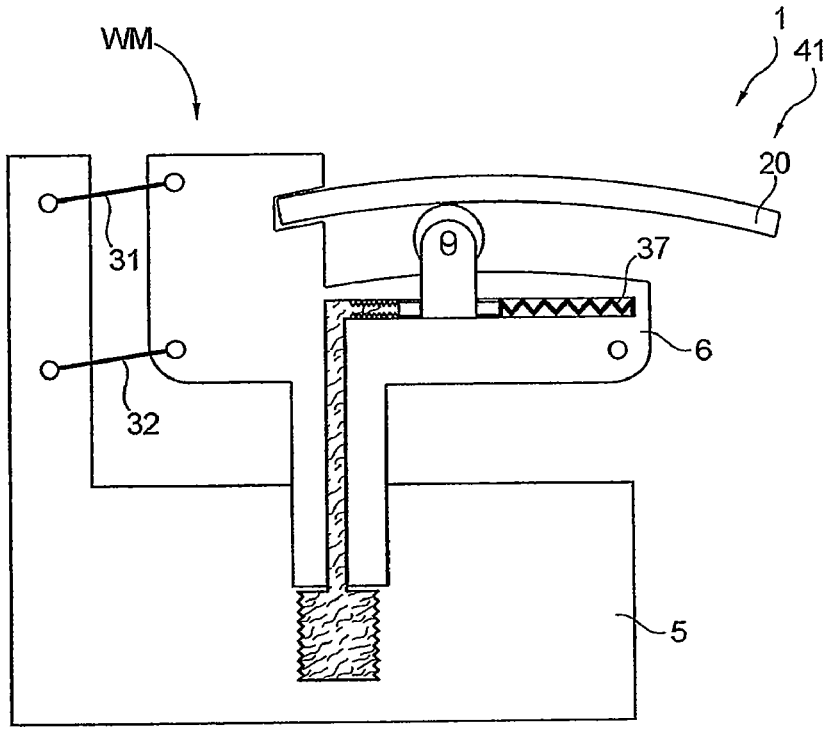

The arrangement illustrated in FIG. 6*c* has an operating mode comparable to the arrangement shown in FIG. 6*b*. In contrast to this, the upper part 6 is not guided in the middle part 5 via a column, but, instead, has a guide by means of arms 31, 32 which is known, for example, from FIGS. 2*a* and 2*b*.

Figure 6D:
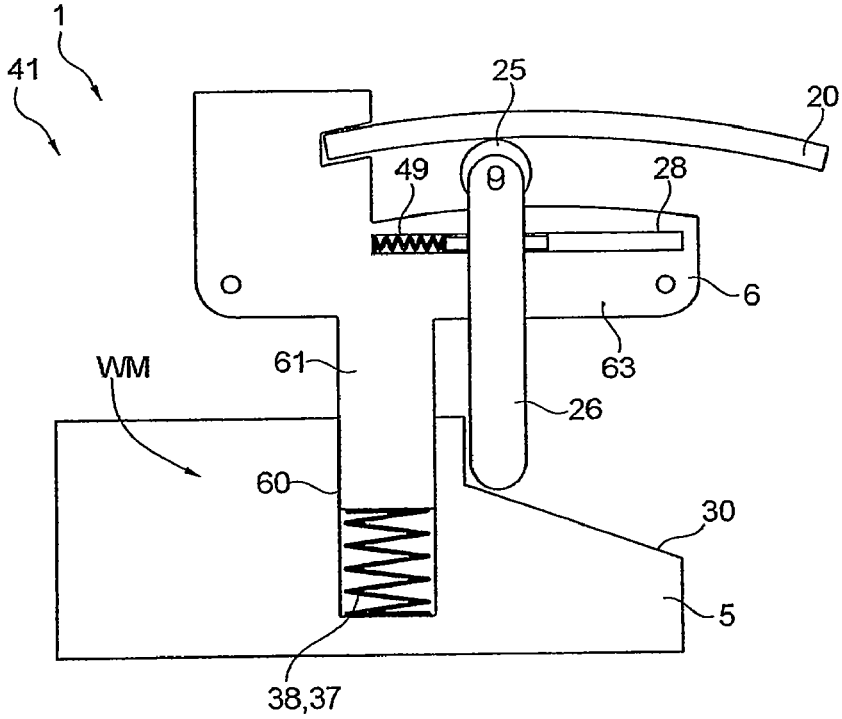

FIG. 6*d* shows a purely mechanical variant. In this, an upper part 6 is guided with a column 61 in a bore 60 of a middle part 5, a second spring element 37 designed as a helical spring 38 being arranged between the column 61 and the middle part 5. A slide 26 is guided in a way known from previous exemplary embodiments on a boom 63 of the upper part 6 in a guide 28. The slide 26 has a support 25 and cooperates with an inclined plane 30. As a result, during a weighing movement of the upper part 6, the slide 26 is moved laterally under a first spring element 20. When the movement converter 41 is relieved of a weight force causing the weighing movement, a tension spring 49 draws the slide 26 in the direction of the column 61 again.

Figure 6E:
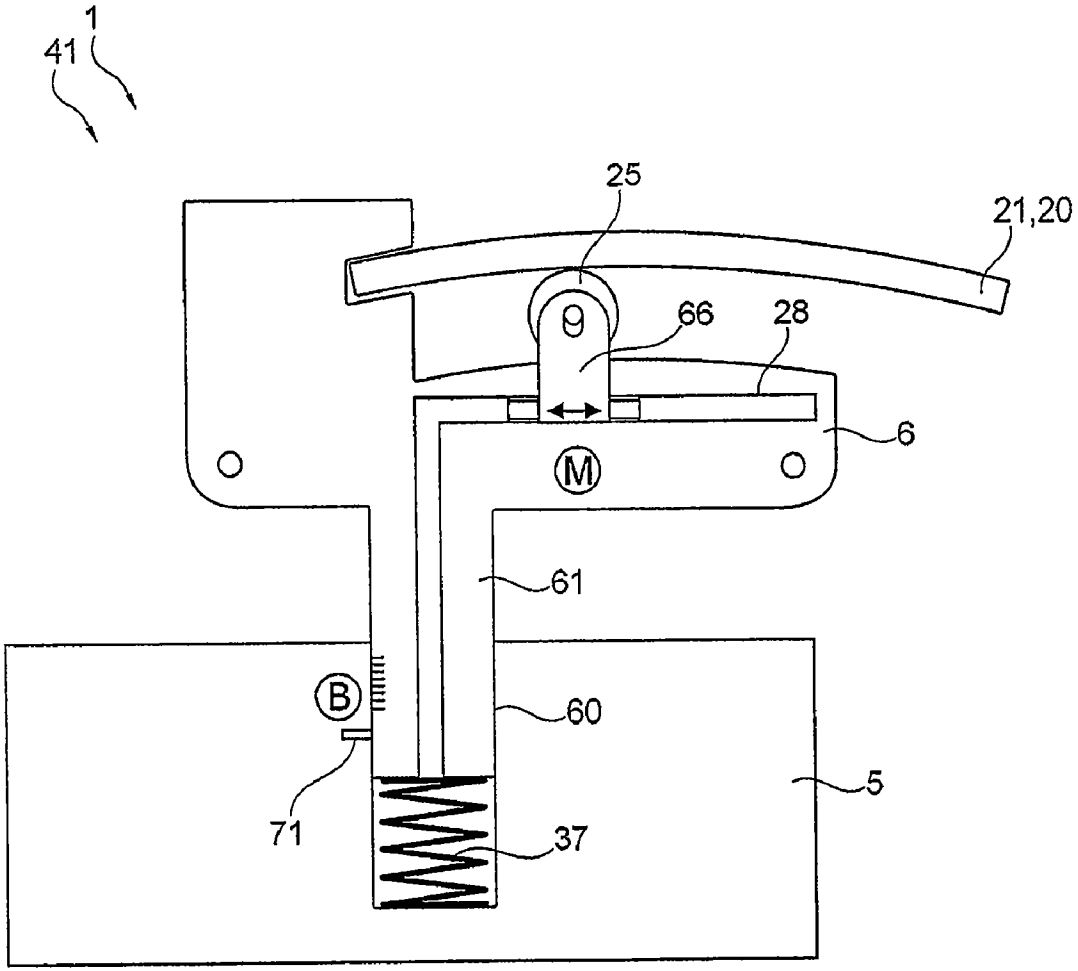

The arrangement illustrated in FIG. 6*e* has an upper part 6 which is guided with a column 61 in a bore 60 of a middle part 5 against a second spring element 37. A weighing distance occurring during the compression of the upper part 6 as a result of a loading of a seat, not illustrated, articulated on the upper part 6 is detected by a sensor 71. A piston 66 is movable motorized in a guide 28 according to the detected weighing distance. The transfer of control signals between the sensor 71 and the motorized movable piston 66 takes place in wired or wireless form. A support 25 is arranged with play in the vertical direction on the motorized movable piston 66 in a way known from previous exemplary embodiments. This moves the piston 66 under a first spring element 20, designed as a leaf spring 21, as a function of the detected weighing distance. When the upper part 6 or the seat arranged on the upper part 6 is relieved, the upper part 6 is raised by the second spring element 37. This lifting movement is likewise detected by the sensor 71 and causes a return movement of the motorized movable piston 66.

In the design variants illustrated in FIGS. 6*a* to 6*e*, the first spring element 20 and the support 25 cooperate according to the description relating to FIGS. 2*a* to 2*c*. In particular, the supports 25 are designed according to FIG. 2*c*, and between the first spring element 20 and the support 25 there is no interspace only when a person sitting on the piece of furniture 1 reclines.

Figure 7A:
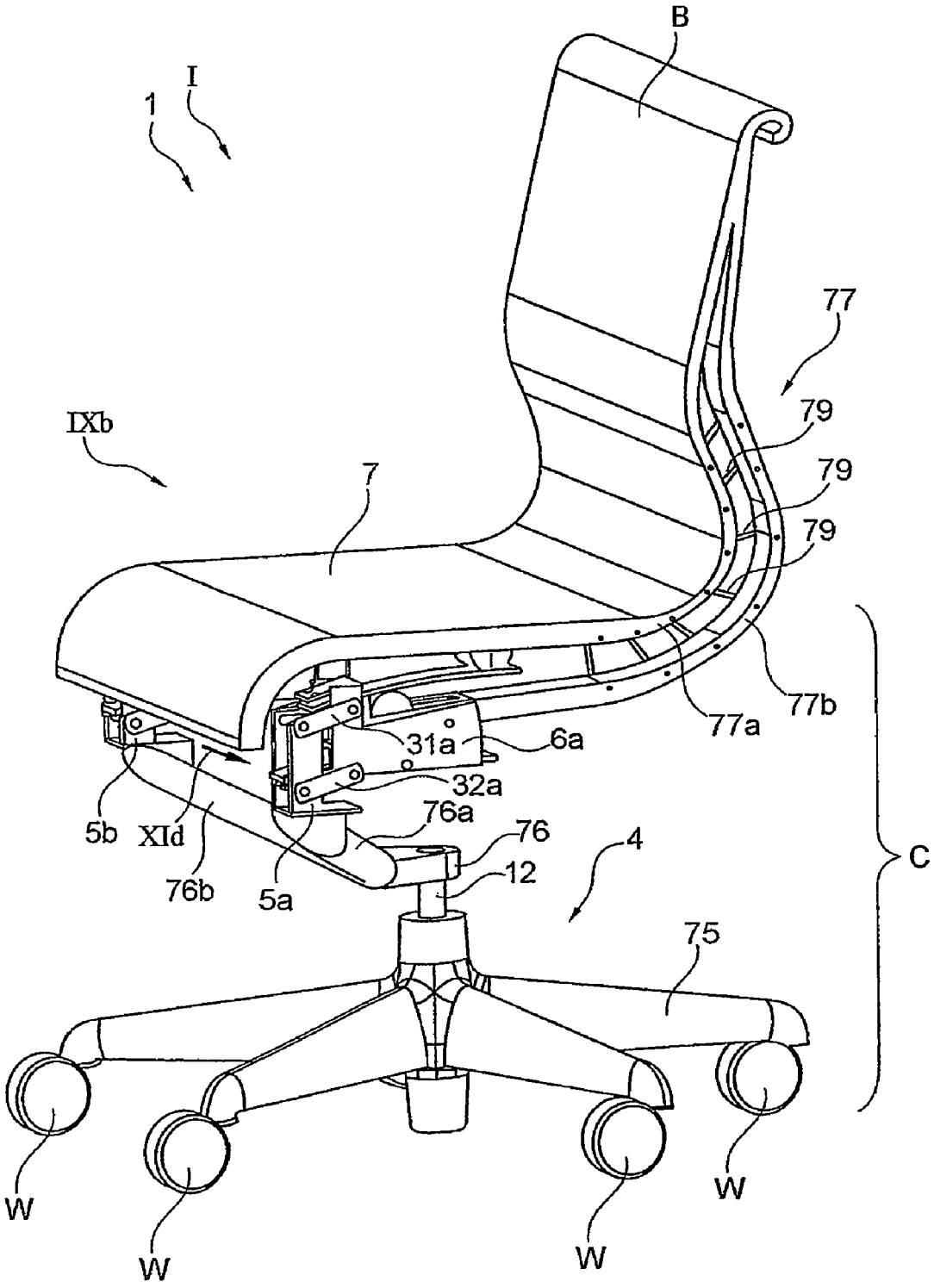
FIGS. 7*a*-7*f* show six illustrations of a further design variant of a piece of furniture according to the invention.

FIG. 7*a* shows a perspective illustration of a piece of furniture 1 according to the invention. The piece of furniture 1 stands in a nonloaded position I and comprises a base C and a seat 7 arranged on the latter. The base C comprises a lower part 4, a two-part middle part 5*a*, 5*b* and a two-part upper part 6*a*, 6*b*. The lower part 4 comprises a base 75 with wheels W, a height adjustment device 12 and a carrier 76 arranged on the latter. The carrier 76 has two carrying arms 76*a* and 76*b*, on which the middle parts 5*a*, 5*b* are arranged. On each of these two middle parts 5*a*, 5*b* is articulated one of the upper parts 6*a*, 6*b* (see also FIGS. 7*b* and 7*c*). The two upper parts 6*a*, 6*b* carry the seat 7. The seat 7 comprises a right carrier 77 and a left carrier 78 (see also FIG. 7*c*), and these carry a cloth covering B. The two carriers 77 and 78 have in each case an upper leg 77*a* and 78*a* and a lower leg 77*b*, 78*b*. These are connected in each case by means of at least two linking members 79, 80 (see also FIG. 7*c*).

Figure 7B:
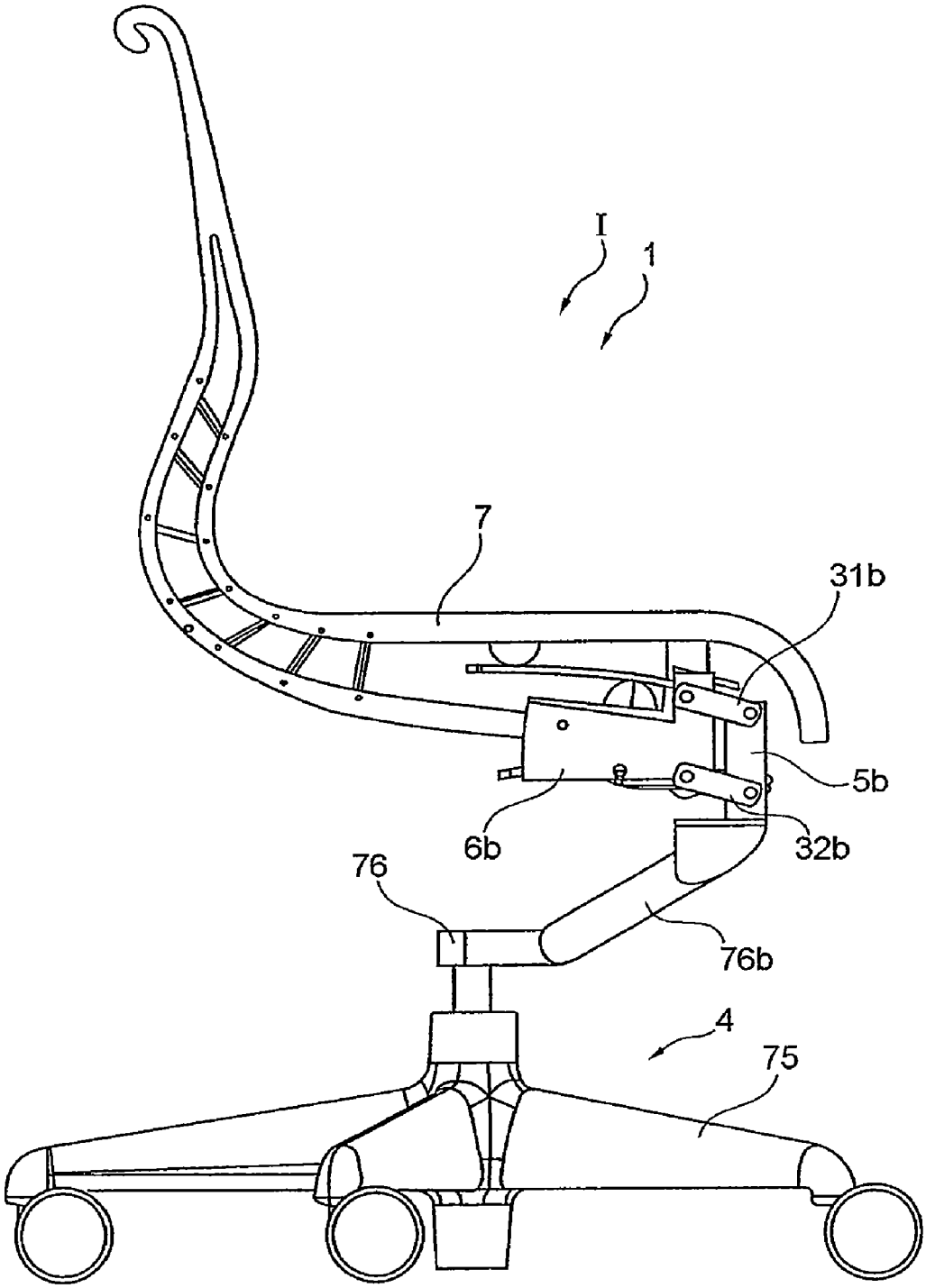

In FIG. 7*b*, the piece of furniture 1 shown in FIG. 7*a* is illustrated in the nonloaded position I in a side view from the direction of an arrow IXb. This side view shows how the upper part 6*b* is guided on the middle part 5*b* via arms 31*b* and 32*b*. The upper part 6*a* is also guided correspondingly on the middle part 5*a* via arms 31*a* and 32*ab* (see FIG. 7*a*).

Figure 7C:
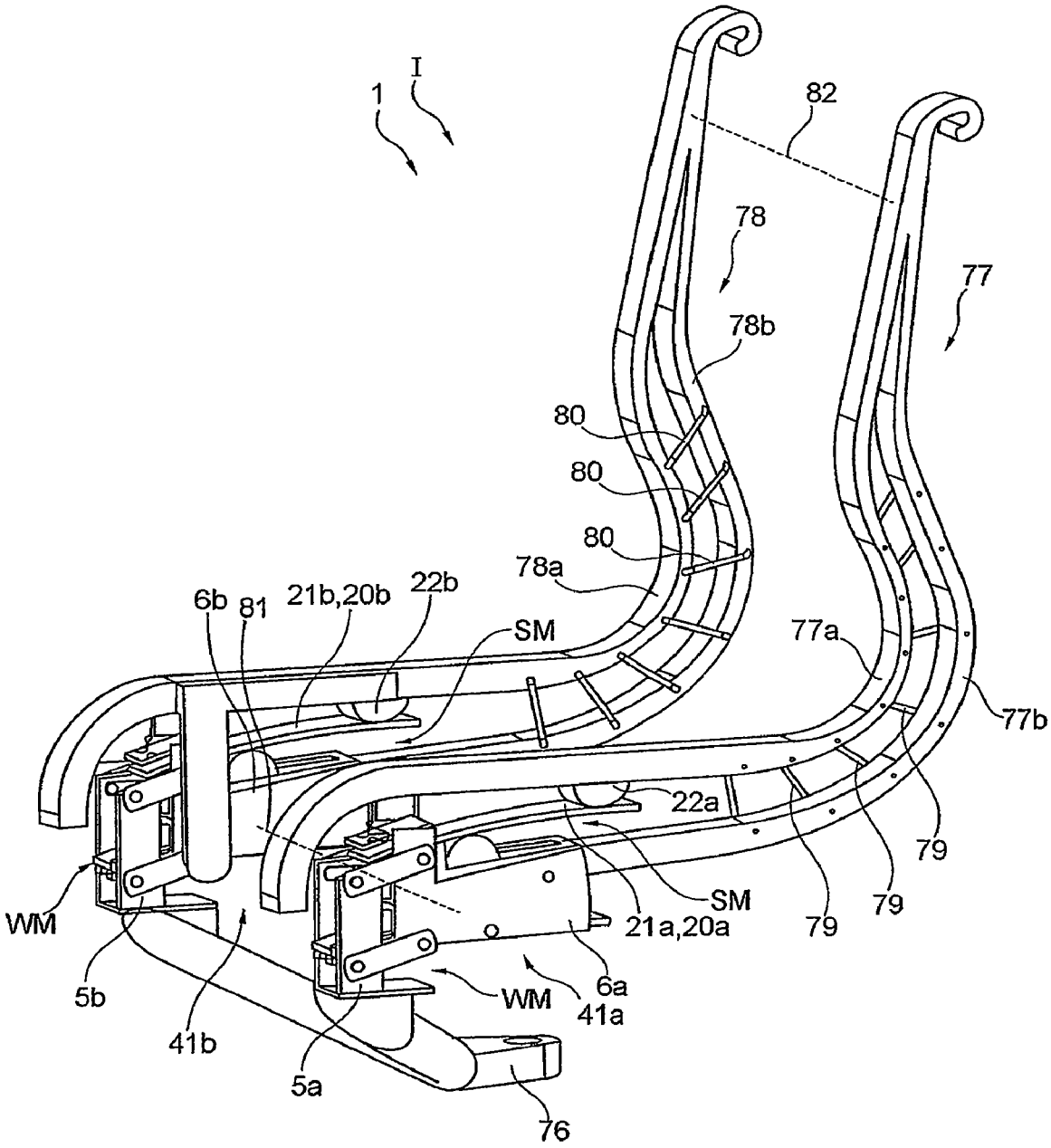

FIG. 7*c* illustrates the piece of furniture 1 without the cloth covering and without the height adjustment device and the base, once again in the nonloaded position I. It can be seen in this view that the upper parts 6*a*, 6*b* of the piece of furniture 1 are not connected to one another directly. In the exemplary embodiment illustrated, the carriers 77, 78, too, are connected to one another only by means of the cloth covering, not illustrated. According to design variants indicated by broken lines, the upper parts 6*a*, 6*b* and/or the carriers 77, 78 are connected by means of at least one flexible or rigid crossmember 81 or 82. Alternatively or additionally to this, there is also provision for connecting the upper part 6*a* and the carrier 78 and/or the upper part 6*b* and the carrier 79 via at least one diagonal crossmember. The upper legs 77*a* and 78*a* of the two carriers 77 and 78 are supported in each case with projections 22*a* and 22*b* on spring elements 20*a*, 20*b* of the two spring mechanisms SM, the spring elements 20*a*, 20*b* being designed as leaf springs 21*a* and 21*b*.

Figure 7D:
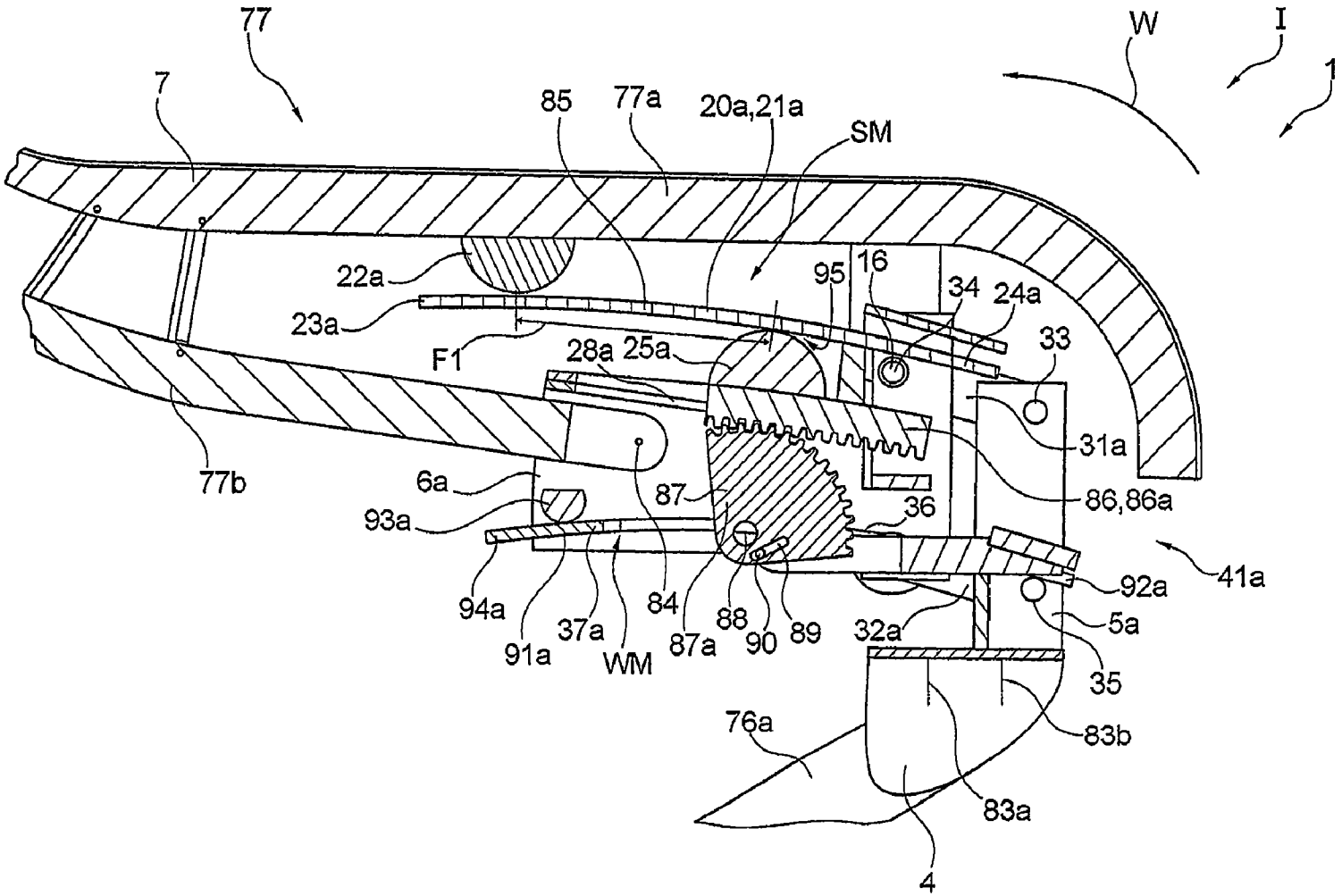

FIG. 7*d* illustrates a sectional view, from a direction IXd shown in FIG. 7*a*, of the movement converter 41*a* formed between the middle part 5*a* and the upper part 6*a*, the piece of furniture 1 also standing in the nonloaded position I here. The middle part 5 is carried by the carrying arm 76*a* belonging to the lower part 4 and is screwed to said carrying arm via screws 83*a*, 83*b*. The upper part 6*a* is articulated movably upward and downward on the middle part 5*a* via the parallel arms 31*a*, 32*a* which are mounted rotatably with axes of rotation 33 to 36 on the upper part 6*a* and the middle part 5*a* respectively. The seat 7 is articulated rotatably on the upper part 6*a* via two axes of rotation 16 and 84. The seat 7 is articulated at the axis of rotation 16 via the upper leg 77*a* of the carrier 77 and at the axis of rotation 84 via the lower leg 77*b* of the carrier 77. Furthermore, the first spring element 20*a* is tension-mounted with a tension end 24*a* into the upper part 6*a*. The upper leg 77*a* of the right carrier 77 of the seat 7 bears with the projection 22*a* against a free end 23*a* of the leaf spring 21*a*. The seat 7 or the right carrier 77 is thereby supported on the first spring element 20*a* in a direction of rotation w. The leaf spring 21*a* is not only tension-mounted into the upper part 6*a*, but is supported in a middle region 85 against the upper part 6*a* by a support 25*a* when a person sitting on the seat reclines. In the nonloaded position I shown in FIG. 7*d*, there is an interspace 95 between the support 25*a* and the leaf spring 21*a*, and therefore these two components have no operative connection, so as not to brake a displacement of the support 25*a* taking place during a loading of the seat 7. This interspace 95 is achieved by means of a corresponding prestress or orientation and/or a corresponding shaping of the leaf spring 21*a*. The leaf spring 21*a* and the support 25*a* form a spring mechanism SM. The support 25*a* is arranged on a toothed slide 86 which is guided laterally displaceably in a guide 28*a* on the upper part 6*a* and forms an output body 86*a*. The toothed slide 86, or linear/curvilinear rack or gear, cooperates with a toothed quadrant 87, or rotary gear, which is fastened to the upper part 6*a* rotatably about an axis of rotation 88 and forms a drive body 87*a*. The toothed quadrant 87 has a slotted guide which is designed as a long hole 89. A pin 90 which is fastened to the middle part 5*a* engages into the long hole 89. The upper part 6*a* is guided on the arms 31*a*, 32*a* against a downwardly directed movement and is supported via a second spring element 37*a*. The second spring element 37*a* is designed as a leaf spring 91*a* and is held with a tension end 92*a* in the middle part 5*a*. The upper part 6*a* acts with a bolt 93*a* on a free end 94*a* of the leaf spring 91*a*. The leaf spring 91*a* and the arms 31*a*, 32*a* together form a weighing mechanism WM. A mechanical interlinking of the weighing mechanism WM and of the spring mechanism SM takes place by means of the movement converter 41*a*. When the seat 7 is loaded with a weight force, the upper part 6*a*, on which the seat 7 is supported, is supported on the second spring element 37*a* and in this case is lowered slightly with respect to the position I shown in FIG. 7*d*. Along with the upper part 6*a*, the toothed quadrant 87 is also moved downward, and the pin 90 fastened rigidly to the middle part 5*a* with respect to the upper part 6*a* causes a rotation of the toothed quadrant 87 about its axis of rotation 88 in the direction of rotation w. The rotating toothed quadrant 87, during its rotational movement, takes up, or meshes with, the toothed slide 86 and the support 25*a* fastened to the latter and transports or translates this support to the left in the direction of the free end 23*a* of the leaf spring 21. A spacing F1 between the support 25*a* and the projection 22*a* is thereby reduced (see FIG. 7*d*). This reduced spacing between the support 25*a* and the projection 22*a* then causes a greater supporting of the seat 7 against an inclination movement of the seat 7 about the axes of rotation 16, as compared with the position shown in FIG. 7*d*, when the person sitting on the seat 7 reclines (see also FIG. 7*f*). A left movement converter 41*b* (see FIG. 7*c*) is designed similarly to the right movement converter 41*a* described above in detail. The piece of furniture 1 thus has a seat 7 which has two weighing mechanisms WM and two spring mechanisms SM which are connected in each case by means of a movement converter 41*a*, 41*b*. As a function of the position of a person sitting on the seat 7 of the piece of furniture 1, these two components are loaded proportionately with a weight force of the person and have corresponding reaction forces of the spring mechanisms SM against an inclination movement of the seat 7 directed in the direction of rotation w.

Figure 7E:
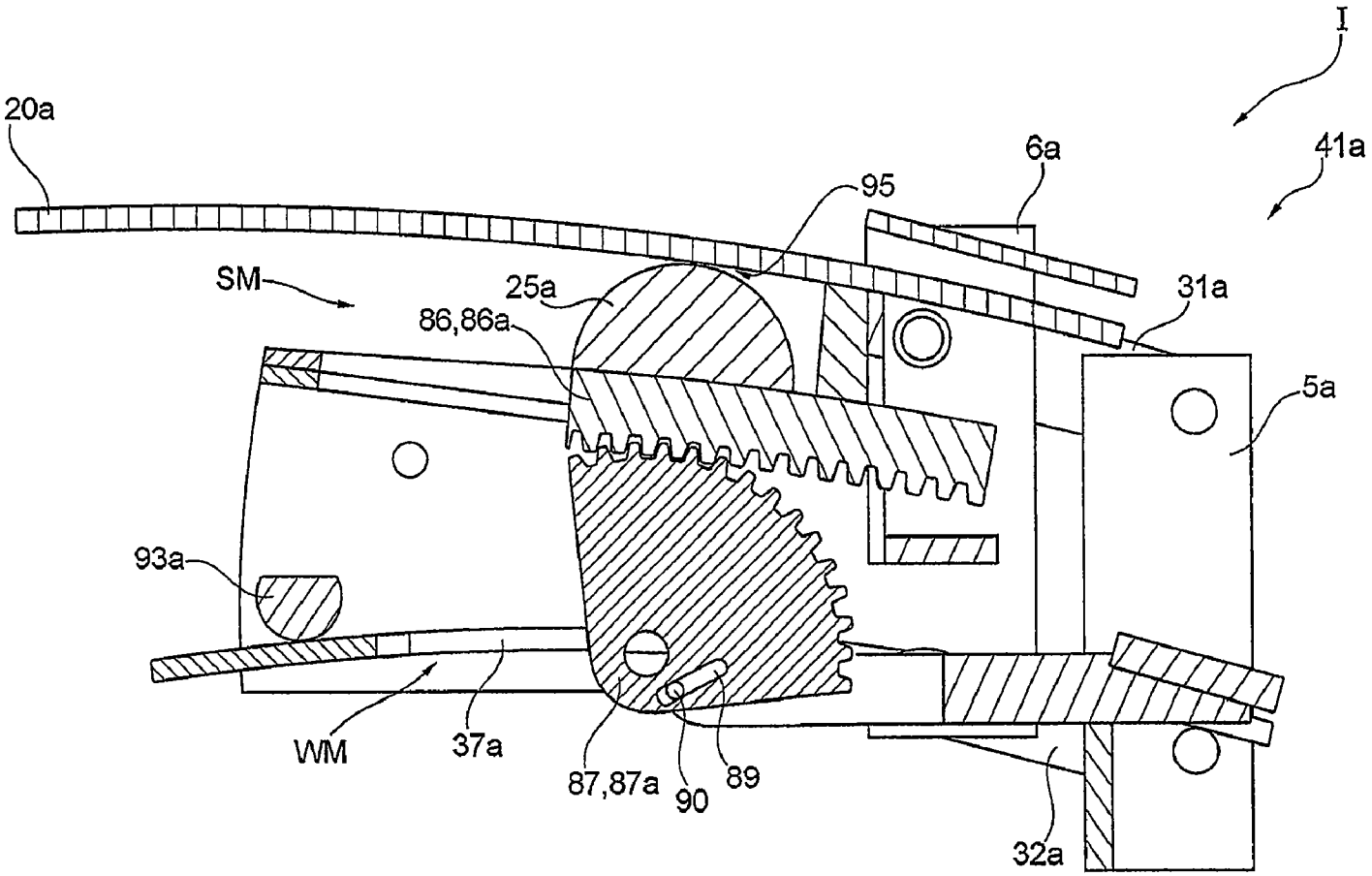

FIG. 7*e* again depicts, in an enlarged illustration, the right movement converter 41*a* shown in FIG. 7*d*, with the associated weighing mechanism WM and the associated spring mechanism SM, in the nonloaded position I. An illustration of the seat 7 and of the lower part 4 has been dispensed with here. Reference is made to the description relating to FIG. 7*d*.

Figure 7F:
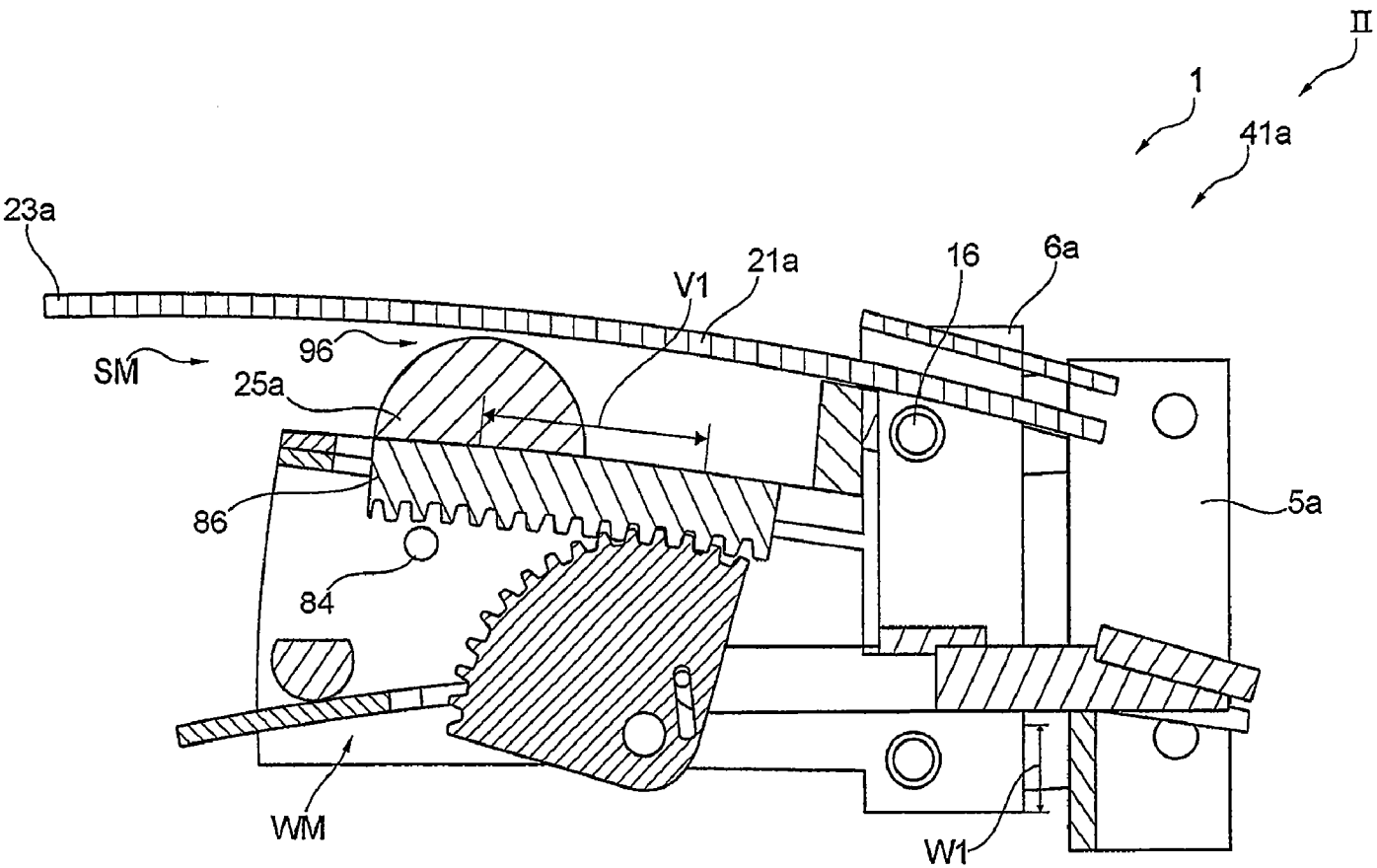

FIG. 7*f* then shows a position II in which the seat 7, not illustrated, is loaded with a weight force of a person sitting upright. In comparison with FIG. 7*e*, the rack 86 together with the support 25*a* of the spring mechanism SM has been displaced in the direction of the free end 23*a* of the leaf spring 21*a*. This displacement movement over the displacement distance V1 is the result of a weighing movement of the upper part 6*a* over a weighing distance W1, where, for example, W1=2.5×V1. A step-up of the weighing movement generated by the weighing mechanism WM thus takes place in the movement converter 41*a*. That is to say, even with a small weighing movement, a sensitive setting of the spring mechanism SM can be carried out on account of the step-up. The setting of the spring mechanism SM and consequently the counterforce against an inclination movement of the seat about the axis of rotation 16 are generated as a function of the weight force with which a person acts on the seat. The counterforce is set by the variation in the spacing between the support 25*a* and the projection, acting on the leaf spring 21*a*, of the seat 7. In the loading situation illustrated in FIG. 7*f*, too, there is still an interspace 96 between the support 25*a* and the leaf spring 21*a*, as long as the person sitting on the seat does not recline.

Figure 8A:
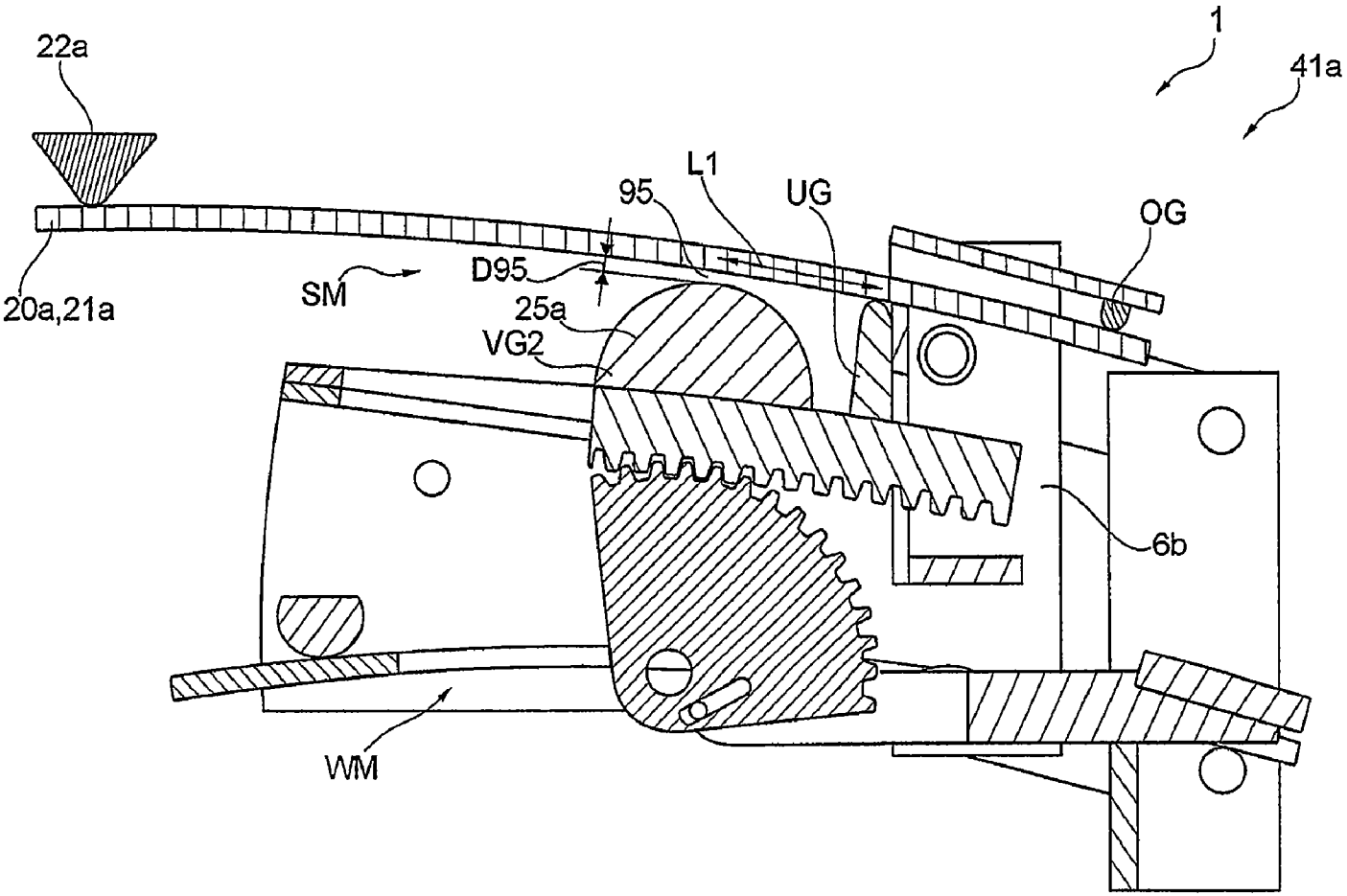
FIGS. 8*a*-8*c* show three illustrations of a movement converter.
Figure 8B:
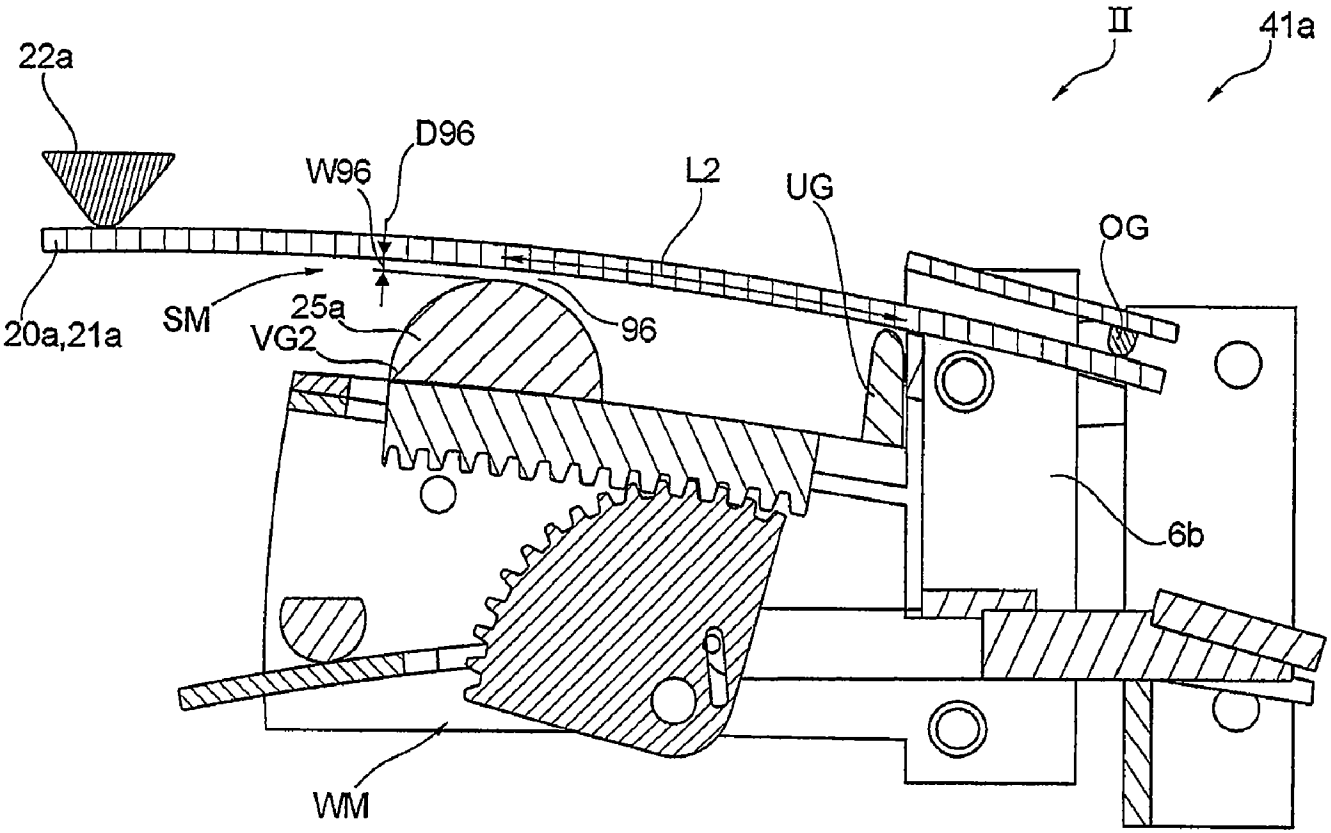
Figure 8C:
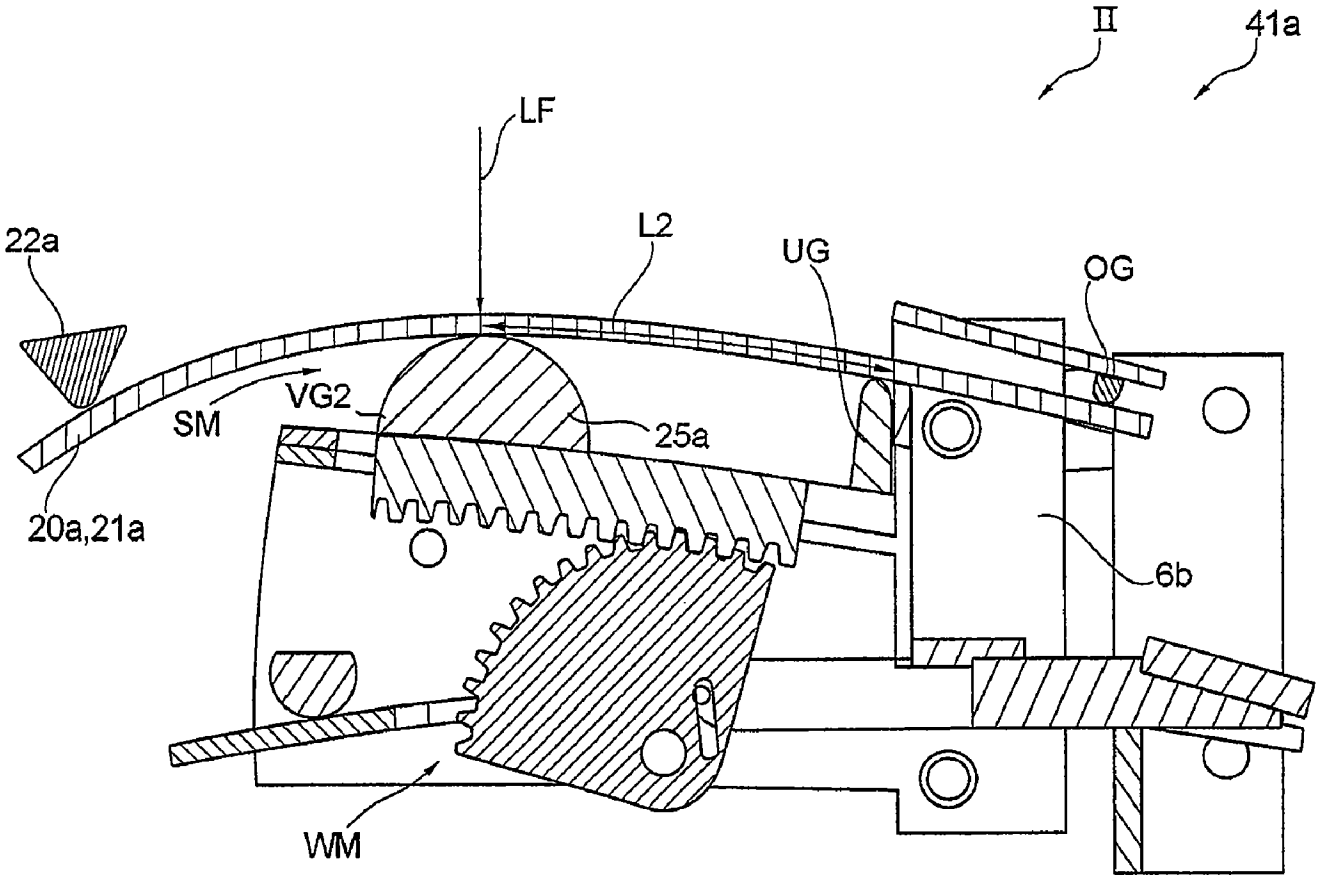

FIGS. 8*a* to 8*c* show once again in detail the weighing and inclination on a further structural unit consisting of the weighing mechanism WM, movement converter 41*a* and spring mechanism SM, the structural unit being modified slightly, as compared with FIGS. 7*a* to 7*f*. FIG. 8*a* shows a support 25*a* in a nonloaded position I of the piece of furniture. The seat, not illustrated, is supported via a projection 22*a*, symbolized by a triangle, on a first spring element 20*a* which is designed as a leaf spring 21*a* and which is tension-mounted on an upper part 6*b* between a lower counterbearing UG and an upper counterbearing OG. In the nonloaded position I illustrated, there is no operative connection between the support 25*a* and the leaf spring 21*a*. Instead, to avoid friction, a first interspace 95 having a thickness D95 is formed between the support 25*a* and the leaf spring 21. As soon as the seat part of the seat, not illustrated, is loaded by a person sitting down in an approximately upright sitting position, the support 25*a* moves under the leaf spring 21*a* into a position II shown in FIG. 8*b*. During this movement of the support 25*a*, there is no operative connection to the leaf spring 21*a*. As long as the person does not recline out of the upright sitting position, an interspace 96 having a thickness D96 is still maintained between the support 25*a* and the leaf spring 21*a*, although, under certain circumstances, the weight force of the person already acts in a small fraction on the leaf spring 21*a* via the projection 22*a*. Thus, while the person is sitting down and as long as the person remains seated in the upright sitting position, a very smooth and therefore rapid follow-up of the support 25*a* under the leaf spring 21*a* is still possible, since an interspace 95 is constantly present. This is advantageous, for example, when the person sitting upright subsequently increases his weight by grasping a heavy file and reclines with this. Owing to the rapid and smooth adjustability of the support 25*a*, the weight of the heavy file is detected for the counterforce to be generated, even before the person reclines. Supporting which is too soft can thereby be avoided. An operative connection or contact between the support 25*a* and the leaf spring 21*a* occurs only when the person reclines out of his upright sitting position, since weight-dependent supporting is required only for reclining. The increased and weight-dependent counterforce is generated, after a slight compression of the leaf spring 21*a* over a spring travel W96 (see FIG. 8*b*) corresponding to the thickness D96 of the second interspace 96, by the leaf spring 21*a* coming to lie on the support 25 (see FIG. 8*c*). The leaf spring 21*a* engages the support 25*a* under itself with a engaging force LF and thus prevents a displacement of the support 25*a* until the person resumes an upright sitting position according to FIG. 1*f* or stands up. The contact thus occurring or operative connection thus occurring between the leaf spring 21*a* and the support 25*a* leads to an increase in the spring force which acts counter to the seat at the projection 22*a* of the latter. The support 25*a* then forms a second lower counterbearing UG2, the two lower counterbearings UG and UG2 having a spacing L2 with respect to one another (see FIG. 8*a*). This spacing L2 varies in proportion to the weight force of a person sitting on the piece of furniture. In position I, the lower counterbearing UG and the second lower counterbearing UG2 have a smaller spacing L1 with respect to one another.

Figure 9A:
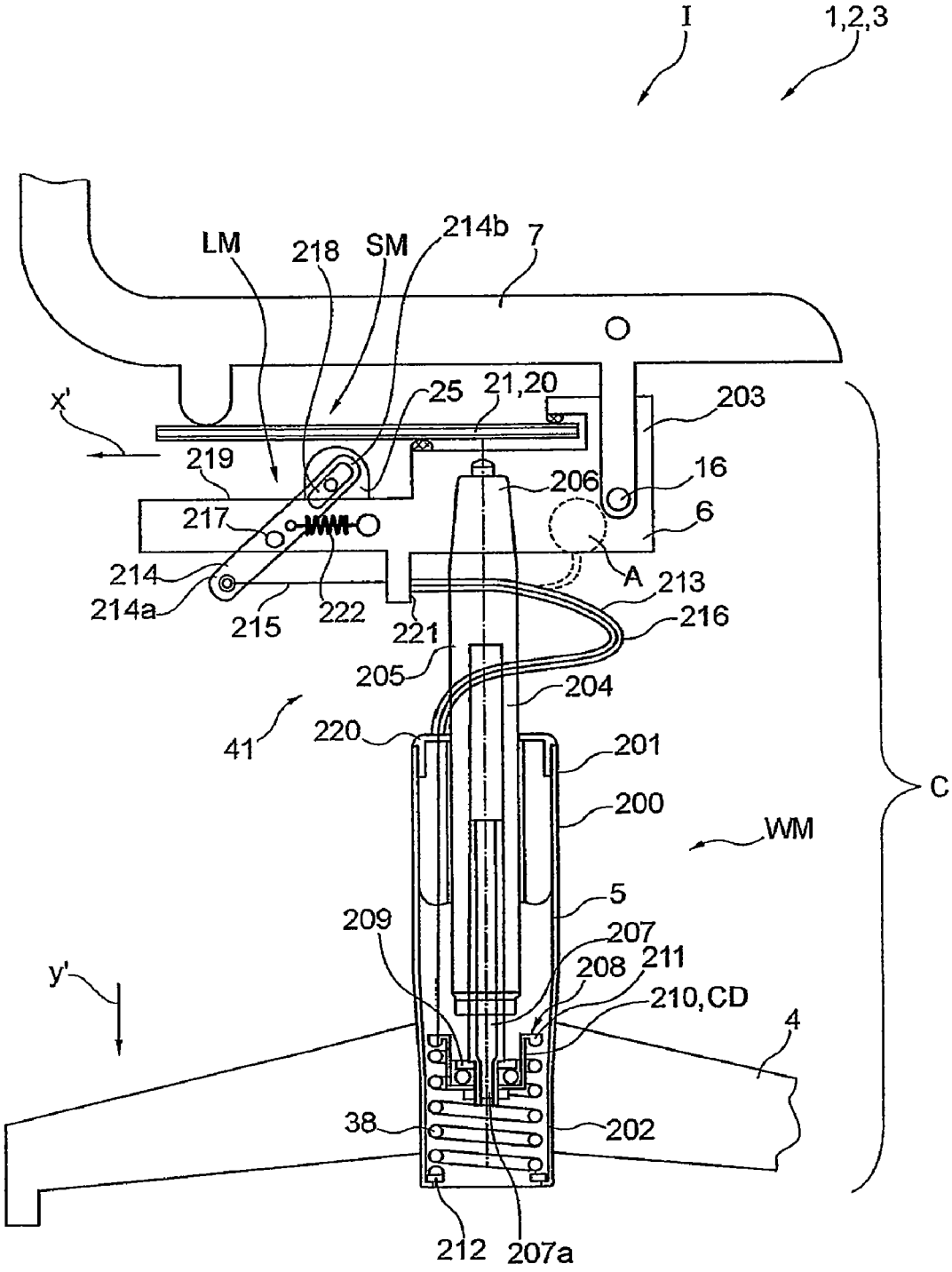
FIGS. 9*a*-9*c* show diagrammatic illustrations of three further design variants of a piece of furniture according to the invention.

FIG. 9*a* illustrates a further design variant of a piece of furniture 1 according to the invention. The piece of furniture 1 is designed as a piece of furniture 2 for sitting on or as a chair 3 and comprises a seat 7 which is arranged on a base C. The chair 3 is shown in a nonloaded position I. The base C comprises a lower part 4, a middle part 5 and an upper part 6. The middle part 5 is formed essentially by a housing 200 which is designed as a quiver 201 and is plugged in a bore 202 of the lower part 4. The upper part 6 comprises a carrier 203 for the seat 7 and is connected to the middle part 5 by means of a height adjustment device 12. The height adjustment device 12 comprises a settable spring AS designed as a pneumatic spring 204, an axial bearing 208 and a spring element designed as a helical spring 38. A pressure tube 205 of the pneumatic spring 204 is fastened in a known way in a bore 206 of the carrier 203. In addition to the pressure tube 205, the pneumatic spring 204 comprises a piston rod 207 which is guided in the pressure tube 205. The axial bearing 208 comprises an upper disk-shaped ring 209 and a lower pot-shaped ring 210 which has a collar 211. The axial bearing 208 is fastened to a free end 207*a* of the piston rod 207. The pneumatic spring 204 is supported via the collar 211 of the axial bearing 208 on a bottom 212 of the middle part 5 via the helical spring 38. Above the helical spring 38, the pneumatic spring 204 is guided slidably with its pressure tube 205 on the lower part 5. A weighing mechanism WM is thus formed between the middle part 5 and the upper part 6 by the height adjustment device 12. A movement converter 41 comprises a Bowden cable 213 and a lever mechanism LM designed as a lever 214. The Bowden cable 213 consists of a wire 215 and of a hose 216 in which the wire 215 is guided. The lever 214 is fastened to the upper part 6 or the carrier 203 rotatably about an axis of rotation 217. The lever 214 has a lower free end 214*a* and an upper free end 214*b*. On the upper free end 214*b* is formed a long hole 218 in which a support 25 is guided. The support 25 is movable on a sliding surface 219 of the carrier 203 under a spring element 20 designed as a leaf spring 21 in the direction of an arrow x', the traveling movement being generated by a rotation of the lever 214 about its axis of rotation 217. The lower end 214*a* of the lever 214 is connected to the collar 211 of the lower ring 210 of the axial bearing 208 by means of the wire 215 of the Bowden cable 213. The housing 200 which forms the middle part 5 and the carrier 203 form in each case a counterbearing 220, 221 for the hose 216 in which the wire 215 is guided. During a loading of the seat 7, the lowering of the upper part 6 counter to the helical spring 38 leads, independently of a height setting preselected by means of the pneumatic spring 204, to a traveling movement of the support 25 in the direction of the arrow x'. The wire 215 of the Bowden cable 213 is drawn downward by the lower ring 210 of the axial bearing 208 in the direction of an arrow y'. The lower ring 210 of the axial bearing 208 forms a fastening device CD for the Bowden cable 213. After a relief of the seat 7, a spring 222 draws the lever 214 back again into the position shown in FIG. 9*a*. The leaf spring 21 and the support 25 form a spring mechanism SM. The distance over which the upper part 6 travels into the middle part 5 when the seat 7 is loaded by a person sitting down upright onto the seat 7 against the helical spring 38 is converted via the Bowden cable 213 and the lever 214 into a traveling movement of the support 25. The support 25 is thereby displaced under the leaf spring 21 as a function of the weight of the person sitting upright on the seat 7. The leaf spring 21 comes to lie on the support 25 only when the person sitting on the seat 7 reclines and generates an increased torque about a horizontal axis of rotation 16, via which the seat 7 is connected pivotably to the upper part 6. A torque which the person in the upright sitting position generates about the axis of rotation 16 is absorbed via a prestress of the leaf spring 21. This prevents the situation where the leaf spring 21 comes to lie on the support 25 before the latter has reached a position appropriate to the person's weight. An operating element A, which is connected to the Bowden cable 213 instead of the lower ring 210, is also illustrated as a design variant in FIG. 9*a* by broken lines. The operating element A allows a manual setting of the body weight of a person sitting on the piece of furniture 1. The operating element can be operated with minimal effort by a person sitting upright or bent forward on the piece of furniture 1.

Figure 9B:
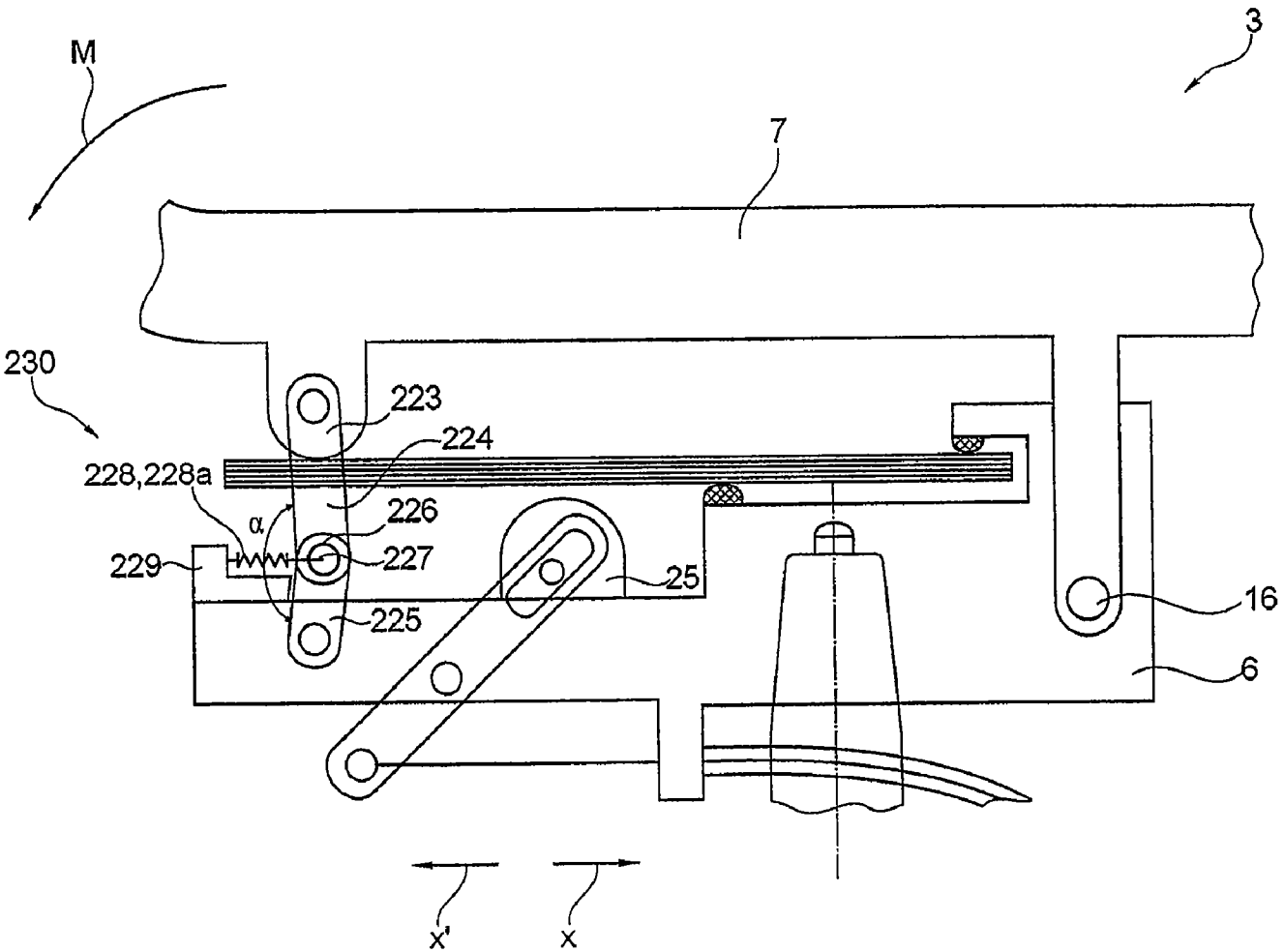

FIG. 9*b* illustrates a view of a detail of the chair 3 shown in FIG. 9*a*. The view of a detail shows a design variant in which the seat 7 and the upper part 6 are connected by means of a toggle lever 223. The toggle lever 223 serves for absorbing the torque M which the person sitting in an upright sitting position on the seat 7 generates about the axis of rotation 16. The above-described prestress of the leaf spring 21 may thereby be largely dispensed with. The toggle lever 223 comprises an upper lever 224, which is articulated rotatably on the seat 7, and a lower lever 225, which is articulated rotatably on the upper part 6. The upper lever 224 and the lower lever 225 are connected to one another by means of a joint 226. The joint 226 forms an axis of rotation 227. A spring element 228, which is designed as a spring 228*a*, is connected to the joint 226 and draws the lower lever 224 of the toggle lever 223 against an abutment 229 which is fastened to the carrier 203. The toggle lever 223 is thereby brought into an approximately extended position. The abutment 229 is designed such that the levers 224 and 225 form with one another an angle $\alpha$ of about 175°. The toggle lever 223 consequently buckles only when the person reclines and therefore generates an increased torque about the axis of rotation 16. Owing to the choice of the angle $\alpha$, at which the levers 224 and 225 stand in relation to one another, and/or to the choice of the spring force of the spring element 228 and/or to the arrangement of the toggle lever 223 between the seat 7 and the upper part 6, it is possible to adapt a blocking mechanism 230 to the special geometry of the chair 3. When the toggle lever 223 buckles as a result of loading, the leaf spring 21 assumes the support or supporting of the seat 7. At the point in time when the toggle lever 223 buckles in the direction of an arrow x, the support 25 has already been displaced in the direction of the arrow x' by the person according to the loading of the seat 7.

Figure 9C:
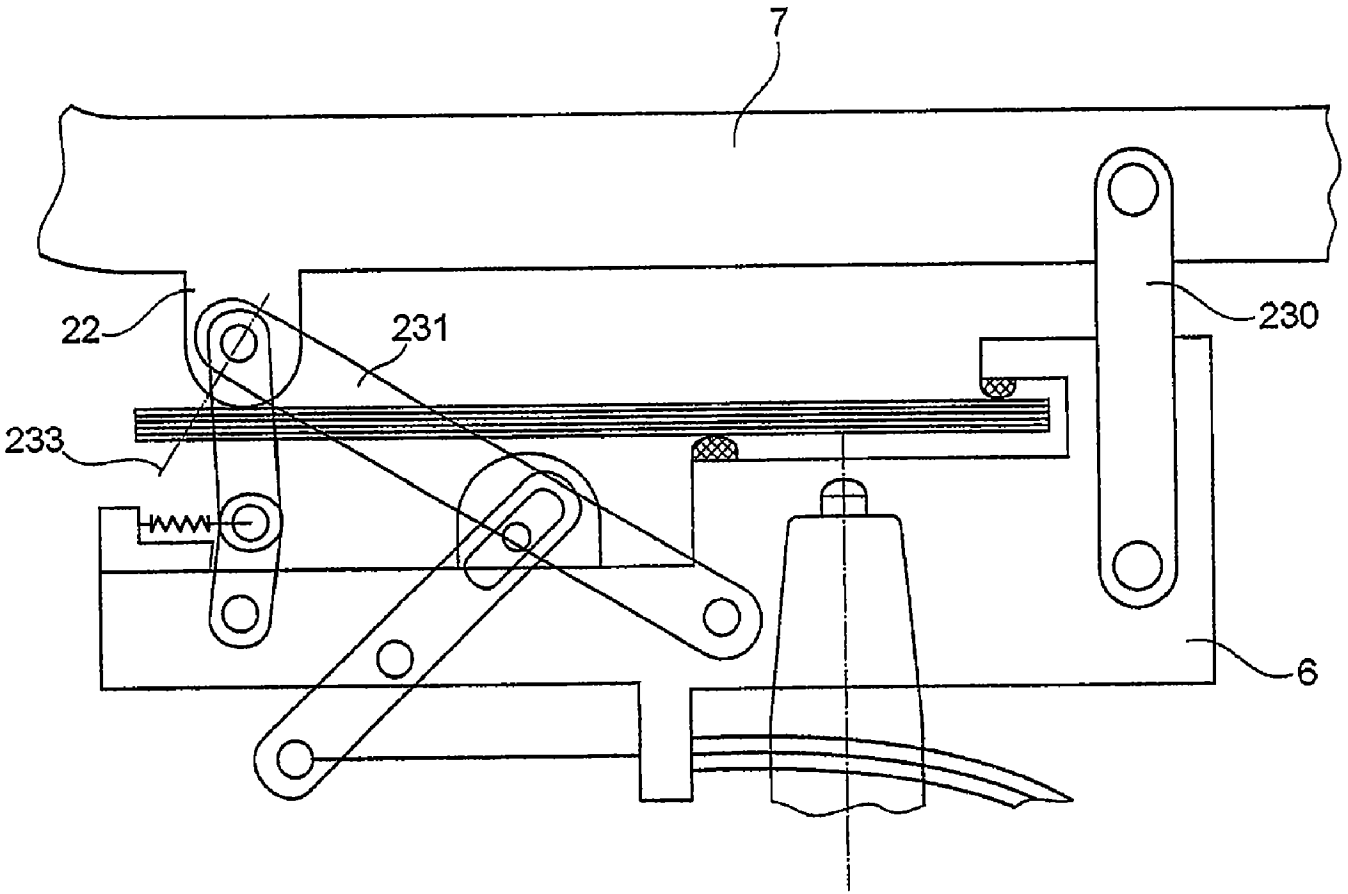

FIG. 9*c* illustrates once again the view, known from FIG. 9*b*, of a detail of the chair 3 shown in FIG. 9*a*. In contrast to FIG. 9*b*, the seat 7 is articulated on the upper part 6 via two additional levers 230 and 231. By means of the lever 231, a projection 22 with which the seat 7 lies on the leaf spring 21 is forced onto a circular path 233 predetermined by the lever 231.

FIGS. 10*a*-10*d* illustrate a design variant of the seat shown in FIGS. 7*a* to 7*d*, in which a weighing mechanism WM and a movement converter 41 are designed similarly to the chair shown in FIG. 9*a*.

Figure 10A:
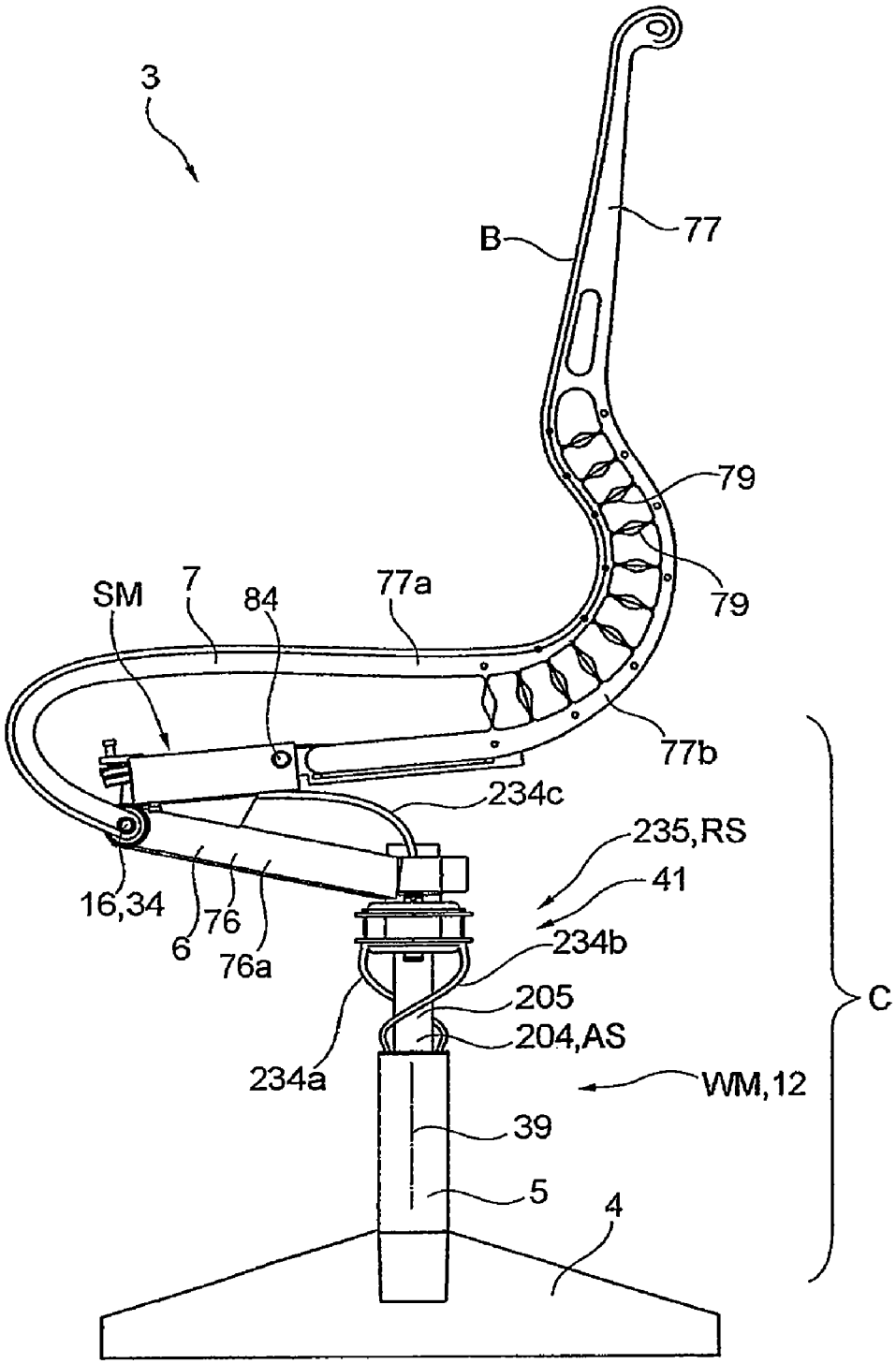
FIGS. 10*a*-10*d* show four illustrations of a further design variant of a piece of furniture according to the invention.

FIG. 10*a* shows a side view of a chair 3. The chair 3 comprises a base C and a seat 7. The base C comprises a lower part 4, which receives a middle part 5 in a bore 202, and an upper part 6, which is connected to the middle part 5 via a weighing mechanism WM designed as a height adjustment device 12. In the side view illustrated, a carrier 77 can be seen, which is articulated on the upper part 6 with an upper leg 77*a* rotatably about an axis of rotation 16 and rotatably with a lower leg 77*b* about an axis of rotation 84. The chair 3 also has a second carrier which is concealed by the first carrier 77 in the illustration of FIG. 10*a*. As regards the arrangement of the second carrier, reference is made to FIG. 7*c* which shows a chair with a comparable construction. The seat 7 is formed essentially by the two carriers 77 and a body support member, configured in one embodiment as a cloth covering B, which bridges and connects the carriers 77.

The two legs 77*a* and 77*b* are connected to one another via a plurality of linking members 79. The two carriers 77 of the seat 7 are supported on the upper part 6 in each case via a spring mechanism SM. The seat 7 is rotatable together with the upper part 6 about a vertical axis of rotation 39 with respect to the middle part 5 and to the lower part 4. The weighing mechanism WM comprises a settable spring AS which is designed as a pneumatic spring 204. The upper part 6 comprises a carrier 76 which is composed of two mirror-symmetrically designed carrying arms 76*a*, only one of the carrying arms 76*a* being visible in the illustration of FIG. 10*a*. As regards the basic design, reference is made once again to FIG. 7*c* which shows a chair in which the carrying arm is of comparable design. Of the movement converter 41, three Bowden cables 234*a*, 234*b* and 234*c* can be seen in FIG. 10*a*. Furthermore, the movement converter 41 comprises a coupling 235, by means of which the Bowden cables 234*a*, 234*b* and 234*c* are decoupled from a rotation of the upper part 6 with respect to the middle part 5. The coupling 235 is designed as a rotor system RS.

Figure 10B:
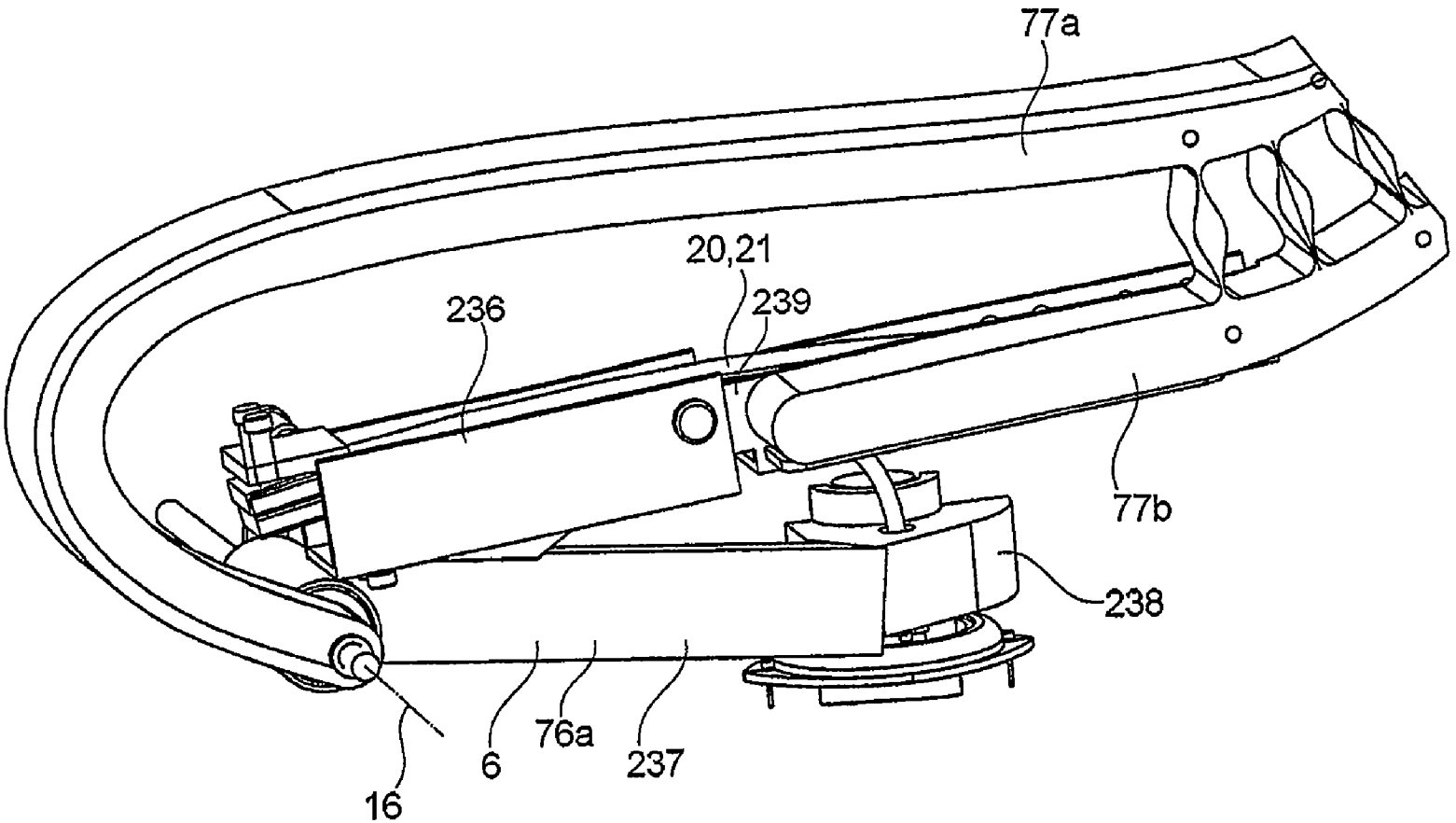

FIG. 10*b* shows an enlarged and slightly perspective illustration of the chair 3 shown in FIG. 10*a*, in the region of the carrying arm 76*a* of the upper part 6. The carrying arm 76*a* consists of an upper leg 236 and of a lower leg 237. The two legs 236, 237 are connected rigidly to one another. The carrying arm 76*a* is fastened with a free end 238 of the lower leg 237 to a pressure tube 205 of the pneumatic spring 204. Tension-mounted as a spring element 20 in the upper leg 236 of the carrier 76*a* is a leaf spring 21 on which the lower leg 77*b* of the carrier 77 is supported with an adaptor 239.

Figure 10C:
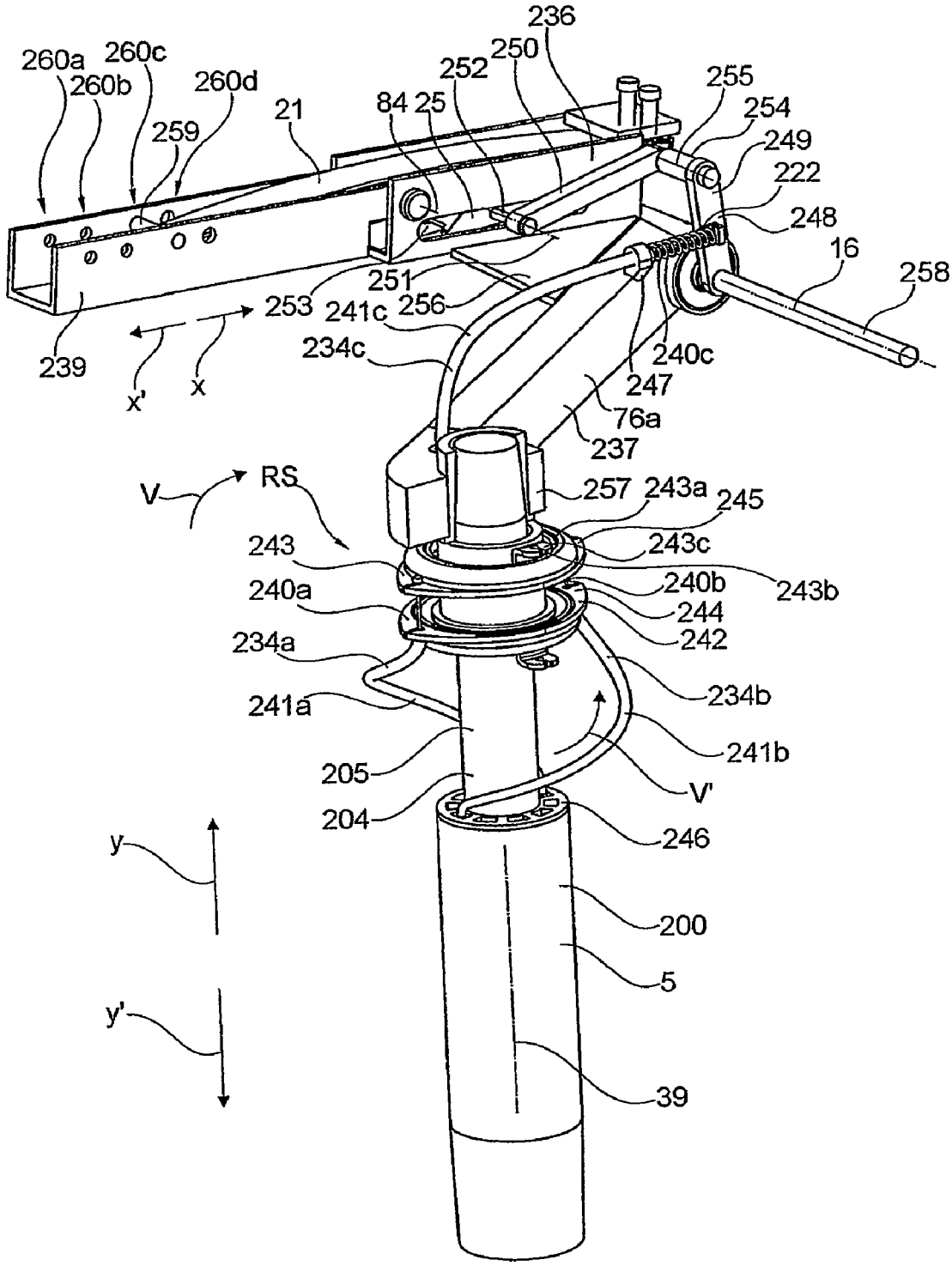

FIG. 10*c* shows a perspective view of the adaptor 239 of the lower leg 77*b*, the middle part 5 and all the components lying between these. For the sake of clarity, once again, of the upper part 6 with the carrying arm 76*a*, only one of the carrying arms is illustrated. When the upper part 6 is loaded via the seat, not illustrated, the upper part 6, together with the pneumatic spring 204, is compressed with respect to the middle part 5. The rotor system RS comprises a lower ring 242, an upper ring 243 and an inner ring 243*a*. These are arranged on the pressure tube 205 of the pneumatic spring 204. The lower ring 242 is mounted on the pressure tube 205 rotatably about the longitudinal axis 39 of the latter and forms a counterbearing 244 for the hoses 241*a* and 241*b* of the Bowden cables 234*a* and 234*b*. The middle part 5 is designed as a housing 200 and forms a further counterbearing 246 for the hoses 241*a* and 241*b* of the Bowden cables 234*a* and 234*b*. The upper ring 243 is mounted on the pressure tube 205 rotatably about the longitudinal axis 39 of the latter and vertically displaceably in the direction of the longitudinal axis 39 or in the directions of the arrows y' and y. The wires 240*a* and 240*b* of the lower Bowden cables 234*a* and 234*b* are fastened to the upper ring 243. The inner ring 243*a* is mounted in the upper ring 234 and is freely rotatable about the axis of rotation 39 with respect to the upper ring 234 and with respect to the pressure tube 205. A wire 240*c* of the upper Bowden cable 241*c* is fastened to the inner ring 243*a*. In a comparable way, a wire of a further upper Bowden cable, not illustrated, is fastened in a slit 234*b* of a tab 243*c* belonging to the inner ring 243*a*. This further upper Bowden cable, not illustrated, is connected to the second spring mechanism which is arranged on the second carrier, not illustrated. The movement converter 41 thus connects the weighing mechanism WM to two spring mechanisms SM, each of the two spring mechanisms SM assuming half the supporting of an inclination movement of the seat 7 about the axis of rotation 16. The hose 241*c* of the upper Bowden cable 234*c* is supported on the lower leg 237 in the carrier arm 76*a*. During a rotation of the seat or of the upper part 6 in a direction of rotation v or v' about the axis of rotation 39, the upper Bowden cables 234*c* rotate together with the pneumatic spring 204 and with the inner ring 243*a* fastened to the pressure tube 205. Due to the lower Bowden cables 234*a* and 234*b* connected to the stationary middle part 5, the rings 242 and 243 are held in their position shown in FIG. 10*c*. During a loading of the seat or of the upper part 6, the wires 240*a* and 240*b* are drawn downward in the direction of an arrow y'. These then draw the upper ring 243 onto the lower ring 242. The upper ring 243 takes up the inner ring 234*a* in the direction of the arrow y'. The wire 240*c* of the Bowden cable 234*c*, which connects the inner ring 243*a* and a first lever 248 of a toggle lever 249, thereby draws the first lever 248 in the direction of a lug 247 counter to the force of a spring 222. The lever 248 is mounted on the upper part rotatably about the axis of rotation 16 of the seat. A second lever 250 of the toggle lever 249 is connected to a support 25 rotatably about an axis of rotation 251. The support 25 is fastened to the second lever 250 via a shaft 252 and is guided in the upper leg 236 of the upper part 6 beneath the leaf spring 21. For this purpose, the upper leg 236 has a long hole 253. The two levers 248 and 250 are connected to one another rotatably about an axis of rotation 255 by means of a pin 254. During the loading of the seat, the support 25 is therefore displaced in the direction of an arrow x'. When the seat is relieved and the upper ring 243 is thereby released by the Bowden cables 234*a* and 234*b*, the spring 222 presses the first lever 248 of the toggle lever 249 back again into the position shown in FIG. 10*c*. During this rotational movement of the first lever 248 about the axis of rotation 16, the support 25 is also drawn back in the direction of an arrow x. The upper ring 243 is simultaneously raised again via the wire 240*c* of the Bowden cable 241*c* into the position shown in FIG. 10*c*. It can be seen clearly in FIG. 10*c* how the upper leg 236 and the lower leg 237 of the carrying arm 76*a* are welded to one another by means of a triangular steel plate 256 so as to form a unit. Arranged mirror-symmetrically to a contact surface 257 of the carrying arm 76*a* is the abovementioned second carrying arm which carries the abovementioned second carrier. A bar 258, only half of which is illustrated, connects the carrying arm 76*a* to the carrying arm not illustrated. The lower leg, not illustrated in FIG. 10*c*, of the carrier is articulated on the upper part 6 rotatably about the axis of rotation 84 by means of the adaptor 239 and is supported on the leaf spring 21 via a bolt 259. Depending on the design of the seat or of the carriers, the bolt 259 may be installed in the adaptor 239 in four different positions 260*a* to 260*d*. As long as the seat is loaded by a person sitting upright, the support 25 is displaceably under the leaf spring 21, without the support 25 touching the leaf spring 21. This is achieved by means of a prestress of the leaf spring 21 which can be set via screws 261*a* and 261*b*.

Figure 10D:
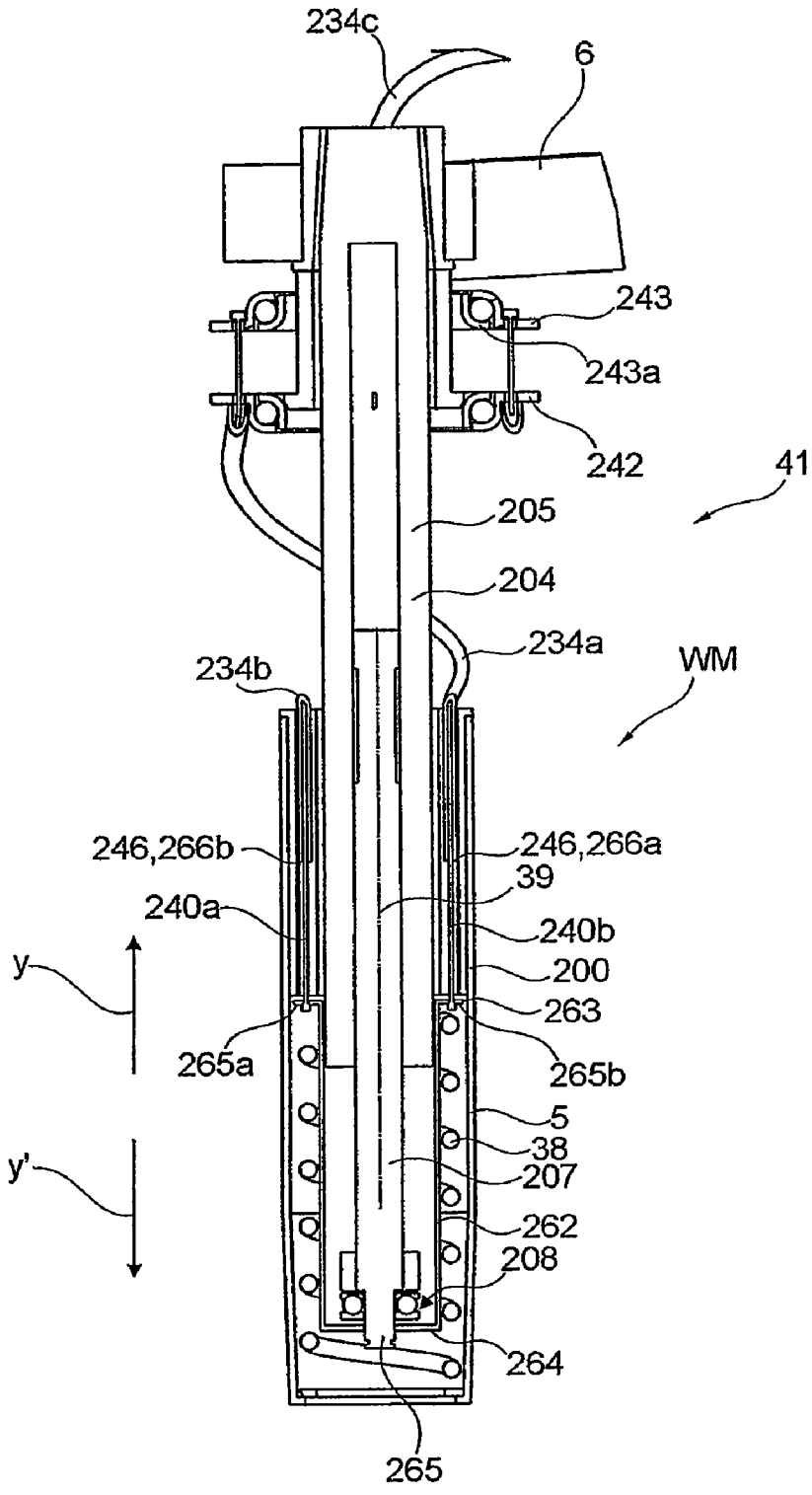

FIG. 10*d*, then, shows the weighing mechanism WM and the movement converter 41 in a sectional view, a hatching of the parts shown in section having been dispensed with so as to keep the illustration clearer. The weighing mechanism WM comprises the pneumatic spring with a piston rod 207 guided in the pressure tube 205, an axial bearing 208, a cup 262 and a helical spring 38. The cup 262 is supported with a collar 263 on the helical spring 38, and the pneumatic spring 204 stands on the axial bearing 208 in the cup 262, the piston rod 207 of the pneumatic spring 204 penetrating through a bottom 264 of the cup 262, and the axial bearing 208 being fastened to a free end 265 of the piston rod 207. The axial bearing 208 allows a free rotatability of the pneumatic spring 204 and of the upper part 6 fastened to the latter, together with the seat, not illustrated, about the axis of rotation 39. The pneumatic spring 204 is guided rotatably with its pressure tube 205, above the helical spring 38, in a housing 200 formed by the middle part 5. The collar 263 of the cup 262 has two slits 265*a* and 265*b*, in which the wires 240*a* and 240*b* of the Bowden cables 234*a* and 234*b* are suspended.

The slits 265*a* and 265*b* in each case form a device CD for fastening the Bowden cables 234*a* and 234*b* of the movement converter 41. By means of abutments 266*a* and 266*b*, the middle part 5 forms the counterbearing 246 for the hoses 241*a* and 241*b* of the Bowden cables 234*a* and 234*b*. A height adjustment of the pneumatic spring 204, in which the piston rod 207 moves further in the pressure tube 205 in the direction of the arrow y or moves further out of the pressure tube 205 in the direction of the arrow y', is compensated by the S-shaped run of the Bowden cables 234*a* and 234*b* (see also FIG. 10*c*). During a loading of the seat by a person sitting down on the seat, the pneumatic spring 204 presses the cup 262 via the axial bearing 208 in the direction of the arrow y' counter to the helical spring 38 and at the same is lowered, together with the cup 262, in the direction of the arrow y'. During this lowering movement, the cup 262 tightens the wires 240*a* and 240*b* of the Bowden cables 234*a* and 234*b*. The upper ring 243 is thereby drawn onto the lower ring 242 and the pull is transmitted to the Bowden cable 234*c* which is fastened to the inner ring 234*a*. The Bowden cable 234*c* then causes a displacement of the support 25 (see FIG. 10*c*). Since the rings 242 and 243 are mounted on the pressure tube 205 of the pneumatic spring 204 rotatably about the axis of rotation 39, they can maintain their position with respect to the middle part 5, even when the seat, the upper part 6 and the pneumatic spring 204 are multiply rotated about the vertical axis of rotation 39 on the axial bearing 208. The rings 242 and 243 thus act as free-running rotors.

The invention is not restricted to exemplary embodiments illustrated or described. On the contrary, it embraces developments of the invention within the scope of the claims.

LIST OF REFERENCE SYMBOLS

1 Body support structure, piece of furniture
2 Piece of furniture for sitting on
3 Chair
4 Lower part
5, 5*a*, 5*b* Middle part
6, 6*a*, 6*b* Upper part
7 Seat
8 Foot as lower part

9 Wall holder as lower part
10 Ceiling holder as lower part
11 Swing as lower part
12 Height adjustment device
13 Seat part of 7
14 Back part of 7
15 Axis of rotation between 13 and 14
16 Axis of rotation of 13 on 6
17 Arm on 7 or 14
18 Axis of rotation on 17 or 6
19 Axis of rotation on 17 or 6
20, 20*a* First spring element
21, 21*a*, 21*b* Leaf spring as first spring element 20
22, 22*a*, 22*b* Projection on 7 or 13
23, 23*a* Free end of 20 or 21 or 21*a*
24, 24*a* Tension end of 20 or 21 or 21*a*
25, 25*a* Support
26 Slide
27 Roller
28, 28A Guide on 6 or 6*a*
29 Lower end of 26
30 Inclined plane on 5
31 Arm between 5 and 6
31*a*, 31*b* Arm between 5*a* and 6*a* or 5*b* and 6*b*
32 Arm between 5 and 6
32*a*, 32*b* Arm between 5*a* and 6*a* or 5*b* and 6*b*
33, 34 Axis of rotation of 31, 31*a*, 31*b*
34 to 36 Axis of rotation of 32, 32*a*, 32*b*
37, 37*a* Second spring element
38 Helical spring as second spring element
39 Vertical axis of rotation
40, 40*a* First and second weight force
41 Movement converter
41, 41*b* Right and left movement converter
42 Circular path
43 Drive
44 Output
45 Gear
46 Path on 6
47 Shaft of 25
48 Long hole on 26
49 Tension spring
50 Helical spring as first spring element 20
51 Lever on 6
52 Axis of rotation between 51 and 6
53 Engagement point of 20 on 51
54 Cam on 5
55 Roller on 6
56 Articulated lever on 5
56*a* Lower lever of 56
56*b* Upper lever of 56
57 Axis of rotation between 56*a* and 56*b*
58 Axis of rotation between 25 and 56
59 Elastic element between 13 and 14
60 Bore in 5
61 Column on 6
62 Duct in 6
63 Boom of 6
64 Hydraulic fluid
65 Reservoir in 5
66 Piston on 6
67 Piston surface of 61
68 Magnetorheological fluid
69 Concertina for 68 in 65
70 Concertina for 68 in 62
71 Sensor on 5
72 Reception slit on 6 for 20
73 Bearing body on 21
74 Reception slit on 5 for 20
75 Bogie, base
76 Carrier
76*a*, 76*b* Carrying arm of 76
77 Right carrier of 7
77*a*, 77*b* Upper and lower leg of 77
78 Left carrier of 7
78*a*, 78*b* Upper and lower leg of 78
79 Spoke of 77
80 Spoke of 78
81 Crossmember between 6*a* and 6*b*
82 Crossmember between 77 and 78
83*a*, 83*b* Screws between 5*a* and 76*a*
84 Axis of rotation of 7 on 6*a*
85 Middle region of 21*a*
86 Toothed slide on 6*a*, output body
86*a* Output body
87 Toothed quadrant on 6*a*, drive body
87*a* Drive body
88 Axis of rotation of 87
89 Long hole in 87
90 Pin on 5*a*
91*a* Leaf spring as second spring element
92*a* Tension end of 91*a*
93*a* Bolt on 6*a*
94*a* Free end of 91*a*
95, 96, 97 First, second, third interspace
98 Spring
99 Helical spring
200 Housing
201 Quiver
202 Bore in 4
203 Carrier
204 Pneumatic spring
205 Pressure tube
206 Bore in 203
207 Piston rod of 204
207*a* Free end of 207
208 Axial bearing
209 Upper ring of 208
210 Lower ring of 208
211 Collar of 210
212 Bottom of 5
213 Bowden cable
214 Lever
214*a* Lower end of 214
214*b* Upper end of 214
215 Wire
216 Hose
217 Axis of rotation of 214
218 Long hole
219 Sliding surface on 203
220 Counterbearing on 5
221 Counterbearing on 6
222 Spring between 214 and 203
223 Toggle lever
224 Upper lever of 223
225 Lower lever of 223
226 Joint
227 Axis of rotation
228 Spring element
228*a* Spring between 226 and 229
229 Abutment on 6 for 223
230 Blocking mechanism
231 Lever between 6 and 7
232 Lever between 6 and 7

233 Toggle lever
234*a* Bowden cable
234*b* Bowden cable
234*c* Bowden cable
235 Coupling
236 Upper leg of 76*a*
237 Lower leg of 76*a*
238 Free end of 237
239 Adaptor on 77*b*
240*a* Wire of 234*a*
240*b* Wire of 234*b*
240*c* Wire of 234*c*
241*a* Hose of 234*a*
241*b* Hose of 234*b*
241*c* Hose of 234*c*
242 Lower ring
243 Upper ring
243*a* Inner ring
243*b* Slit in 243*c*
243*c* Tab of 243*a*
244 Counterbearing formed by 242
245 Counterbearing formed by 243
246 Counterbearing formed by 200
247 Lug
248 First lever of 249
249 Toggle lever
250 Second lever of 249
251 Axis of rotation between 250 and 25
252 Shaft on 25
253 Long hole in 236
254 Pin
255 Axis of rotation between 248 and 250
256 Steel plate between 236 and 237
257 Contact surface of 76*a*
258 Bar
259 Bolt on 239
260*a*-260*d* Position of 259 on 239
261*a* Screw on 6
261*b* Screw on 6
262 Cup in 5
263 Collar of 262
264 Bottom of 262
265*a* Slit in 263
265*b* Slit in 263
266*a* Abutment in 5
266*b* Abutment in 5
I Position of rest or position of 1 (nonloaded)
II Working position or position of 1 (loaded)
III Working position or position of 1 (loaded)
A Operating element
A2 Arm of BF2
AS Settable spring
B Cloth covering of 7
BF Leaf spring
BF2 Leaf spring
C Base or chassis
CD Device for fastening of 41
DR Pressure roller on 6
DN Pressure nose on 6
D95 Thickness of 95
D96 Thickness of 96
F1, F2 Spacing between 25 and 22 in I and II
GL Rubber bearing
HK Horizontal component of a weighing movement
K Curve on which 25 travels
KF Contact surface of 25
LA Left arm of BF
LF Engaging force
LM Lever mechanism
L1 Spacing between UG and UG2 in I
L2 Spacing between UG and UG2 in II
M Torque about 16
N Slot
N1, N2, N3 Level of 6 in I and II and III
OG Upper counterbearing in 72
P Person
P1 Upright sitting posture
P2 Reclined sitting posture
P3 Sitting posture leaning forward
RA Right arm of BF
RS Rotor system
R1 Reaction force of SM in I
R2 Reaction force of SM in II
S1, S2, S3 Position of 26 in I and II and III
SM Spring mechanism
UG Lower counterbearing in 72
UG2 Second lower counterbearing
V1, V2 displacement distance
VK Vertical component of a weighing movement
W Wheel
WM Weighing mechanism
W1, W2 Weighing distance
v, v' Direction of rotation about 39
w Direction of rotation
α Angle between 224 and 225

The invention claimed is:

1. A body support structure comprising:

a spring mechanism operable to support a body support member;

a weighing mechanism comprising a height adjustment device, an axial bearing coupled to the height adjustment device and a spring element supporting the axial bearing, wherein the height adjustment device is moveable against the biasing force of the spring element in response to an application of a body force to the body support member independent of a height adjustment of the height adjustment device; and a movement converter coupled between the weighing mechanism and the spring mechanism, wherein a biasing force of the spring mechanism is adjustable in response to a movement of the height adjustment device against the biasing force of the spring element.

2. A body support structure comprising:

a spring mechanism operable to support a body support member;

a weighing mechanism comprising a height adjustment device, an axial bearing coupled to the height adjustment device and a spring element supporting the axial bearing, wherein the height adjustment device is moveable against the biasing force of the spring element in response to an application of a body force to the body support member independent of a height adjustment of the height adjustment device; and a movement converter coupled between the weighing mechanism and the spring mechanism, wherein a biasing force of the spring mechanism is adjustable in response to a movement of the height adjustment device against the biasing force of the spring element, wherein the movement converter comprises a cable coupled between the weighing mechanism and the spring mechanism.

3. A body support structure according to claim 2 wherein the movement converter further comprises a coupling arranged on the pressure tube, and wherein the cable comprises a first cable coupled between the weighing mechanism and the coupling, and a second cable coupled between the coupling and the spring mechanism.

4. A body support structure according to claim 3 wherein the coupling is adapted to permit relative rotation about a vertical axis between the weighing mechanism and the spring mechanism.

5. A body support structure according to claim 4 wherein the coupling comprises an upper ring vertically and non-rotatably moveable relative to a lower ring.

6. A body support structure according to claim 5 further comprising an inner ring rotatably moveable relative to the upper ring.

7. A body support structure according to claim 6 wherein the inner ring is rotatable with the spring mechanism relative to the upper and lower rings, which are non-rotatable relative to the weighing mechanism.

8. A body support structure according to claim 2 wherein at least a portion of the weighing mechanism is arranged in a housing.

9. A body support structure according to claim 8 wherein the housing comprises a counterbearing for a guide housing the cable.

10. A body support structure according to claim 1 wherein the height adjustment device comprises a pneumatic spring having a pressure tube and a piston rod moveable in the pressure tube.

11. A body support structure according to claim 10 wherein the piston rod is coupled to the axial bearing.

12. A body support structure comprising:

a spring mechanism operable to support a body support member;

a weighing mechanism comprising a height adjustment device and a spring element supporting the height adjustment device, wherein the height adjustment device is moveable against the biasing force of the spring element in response to an application of a body force to the body support member independent of a height adjustment of the height adjustment device; and a movement converter coupled between the weighing mechanism and the spring mechanism, wherein a biasing force of the spring mechanism is adjustable in response to a movement of the height adjustment device against the biasing force of the spring element, wherein the movement converter comprises a rotor system operable to permit relative rotation between the weighing mechanism and the spring mechanism about a vertical axis.

13. A body support structure according to claim 12 wherein the movement converter comprises at least one cable coupled between the weighing mechanism and the spring mechanism.

14. A body support structure according to claim 12 wherein at least a portion of the weighing mechanism is arranged in a housing.

15. A body support structure according to claim 12 wherein the height adjustment device comprises a pneumatic spring having a pressure tube and a piston rod moveable in the pressure tube.

16. A body support structure according to claim 12 wherein the rotor system comprises at least a first ring rotatable relative to a second ring, and wherein the movement converter further comprises a first cable coupled between the weighing mechanism and the first ring, and a second cable coupled between the second ring and the spring mechanism.

17. A body support structure according to claim 16 wherein the first ring comprises a first lower ring and a first upper ring.

18. A body support structure according to claim 17 wherein the first upper and lower rings are vertically and non-rotatably moveable relative to each other.

19. A body support structure according to claim 18 wherein the first cable is coupled to the first upper ring, and a cable guide is coupled to the first lower ring.

20. A body support structure according to claim 19 wherein the first cable is coupled to the height adjustment device.

21. A body support structure according to claim 20 wherein the first cable is coupled to an axial bearing supporting the height adjustment device.

* * * * *